US011898425B2

(12) United States Patent
Anthony et al.

(10) Patent No.: US 11,898,425 B2
(45) Date of Patent: Feb. 13, 2024

(54) DOWNHOLE PERFORATING TOOL WITH INTEGRATED DETONATION ASSEMBLY AND METHOD OF USING SAME

(71) Applicant: GR Energy Services Management, LP, Sugar Land, TX (US)

(72) Inventors: James William Anthony, Missouri City, TX (US); Cameron Michael Bryant, Sugar Land, TX (US); Vadim Akhmadikin, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 17/366,884

(22) Filed: Jul. 2, 2021

(65) Prior Publication Data

US 2021/0332678 A1 Oct. 28, 2021

Related U.S. Application Data

(63) Continuation of application No. 16/676,246, filed on Nov. 6, 2019, now Pat. No. 11,078,763, which is a (Continued)

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC .... E21B 43/116; E21B 43/117; E21B 43/118; E21B 43/119; E21B 43/1185
See application file for complete search history.

(56) References Cited

U.S. PATENT DOCUMENTS 2,409,811 A 10/1946 Taylor et al.
2,595,615 A 5/1952 Sweetman
(Continued)

FOREIGN PATENT DOCUMENTS

CA 2997084 A1 8/2019
CA 3065272 A1 6/2020
(Continued)

OTHER PUBLICATIONS

Albert et al., New Perforating Switch Technology Advances Safety and Reliability for Horizontal Completions, SPE/AAPG/SEG Unconventional Resources Technology Conference, San Antonio, Texas, Jul. 20-22, 2015, pp. 7.
(Continued)

*Primary Examiner* — David Carroll
(74) *Attorney, Agent, or Firm* — J L Salazar

(57) ABSTRACT

An integrated detonation assembly of a perforating unit includes a detonator assembly and a charge assembly. The detonator assembly is positioned in the outer housing and comprises a bulkhead connected to the outer housing; a charge connector connected to the bulkhead, the charge connection having a connection end; a detonator carried by the charge connector; and a trigger coupled to the detonator and to a remote actuator. The charge assembly is insertable into the outer housing, and comprises a charge tube to support shaped charges therein; a charge feedthru; and a receiver. The receiver is at an opposite end of the charge tube, and has a receptacle shaped to matingly receive the connection end of the charge connector and to engage the trigger whereby, upon insertion of the charge assembly into the outer housing, the receiver is oriented and communicatively secured to the detonator assembly.

32 Claims, 35 Drawing Sheets

Related U.S. Application Data continuation-in-part of application No. 16/537,347, filed on Aug. 9, 2019, now Pat. No. 10,858,919.

(60) Provisional application No. 62/717,320, filed on Aug. 10, 2018.

(56) References Cited

U.S. PATENT DOCUMENTS

| | | | |
|---|---|---|---|
| 2,705,159 | A | 3/1955 | Pfau |
| 2,883,932 | A | 4/1959 | Caldwell |
| 3,024,843 | A | 3/1962 | Dean |
| 3,062,292 | A | 11/1962 | Lowrey et al. |
| 3,067,679 | A | 12/1962 | Caldwell et al. |
| 3,107,611 | A | 10/1963 | Caldwell et al. |
| 3,211,222 | A | 10/1965 | Myers |
| 3,246,707 | A | 4/1966 | Bell |
| 3,713,393 | A | 1/1973 | O'Connor et al. |
| 3,966,236 | A | 6/1976 | Vann |
| 4,011,815 | A | 3/1977 | Garcia |
| 4,457,383 | A | 7/1984 | Boop |
| 4,497,224 | A | 2/1985 | Jurgens |
| 4,598,775 | A | 7/1986 | Vann et al. |
| 4,688,640 | A | 8/1987 | Pritchard, Jr. |
| 4,842,093 | A | 6/1989 | Lerche et al. |
| 4,886,126 | A | 12/1989 | Yates, Jr. |
| 5,027,708 | A | 7/1991 | Gonzalez et al. |
| 5,042,594 | A | 8/1991 | Gonzalez et al. |
| 5,088,413 | A | 2/1992 | Huber et al. |
| 5,242,201 | A | 9/1993 | Beeman |
| 5,347,929 | A | 9/1994 | Lerche et al. |
| 5,505,134 | A | 4/1996 | Brooks et al. |
| 5,756,926 | A | 5/1998 | Bonbrake et al. |
| 5,971,072 | A | 10/1999 | Huber et al. |
| 5,984,006 | A | 11/1999 | Read et al. |
| 6,095,583 | A | 8/2000 | Beeman et al. |
| 6,148,263 | A | 11/2000 | Brooks et al. |
| 6,283,227 | B1 | 9/2001 | Lerche et al. |
| 6,383,108 | B1 | 5/2002 | Yoo |
| 6,386,108 | B1 | 5/2002 | Brooks et al. |
| 6,431,269 | B1 | 8/2002 | Post et al. |
| 6,450,541 | B1 | 9/2002 | Bakke |
| 6,520,089 | B1 | 2/2003 | Avanci et al. |
| 6,598,682 | B2 | 7/2003 | Johnson et al. |
| 6,604,584 | B2 | 8/2003 | Lerche et al. |
| 6,752,083 | B1 | 6/2004 | Lerche et al. |
| 6,896,059 | B2 | 5/2005 | Brooks et al. |
| 6,938,689 | B2 | 9/2005 | Farrant et al. |
| 7,007,756 | B2 | 3/2006 | Lerche et al. |
| 7,116,542 | B2 | 10/2006 | Lerche et al. |
| 7,198,101 | B2 | 4/2007 | McGarian et al. |
| 7,336,474 | B2 | 2/2008 | Lerche et al. |
| 7,347,278 | B2 | 3/2008 | Lerche et al. |
| 7,381,957 | B2 | 6/2008 | Medley et al. |
| 7,383,882 | B2 | 6/2008 | Lerche et al. |
| 7,409,987 | B2 | 8/2008 | Fjelde |
| 7,461,580 | B2 | 12/2008 | Bell et al. |
| 7,485,851 | B2 | 2/2009 | Medley et al. |
| 7,485,865 | B2 | 2/2009 | Medley et al. |
| 7,505,244 | B2 | 3/2009 | Lerche et al. |
| 7,520,323 | B2 | 4/2009 | Lerche et al. |
| 7,549,373 | B2 | 6/2009 | Brooks et al. |
| 7,690,429 | B2 | 4/2010 | Creel et al. |
| 7,762,351 | B2 | 7/2010 | Vidal |
| 8,056,632 | B2 | 11/2011 | Goodman |
| 8,091,477 | B2 | 1/2012 | Brooks et al. |
| 8,230,788 | B2 | 7/2012 | Brooks et al. |
| 8,267,012 | B2 | 9/2012 | Peeters et al. |
| 8,576,090 | B2 | 11/2013 | Lerche et al. |
| 8,689,868 | B2 | 4/2014 | Lerche et al. |
| 8,884,778 | B2 | 11/2014 | Lerche et al. |
| 8,960,093 | B2 | 2/2015 | Preiss et al. |
| 9,140,088 | B2 | 9/2015 | Brooks |
| 9,371,709 | B2 | 6/2016 | Brooks |
| 9,382,783 | B2 | 7/2016 | Langford et al. |
| 9,394,767 | B2 | 7/2016 | Brooks et al. |
| 9,459,080 | B2 | 10/2016 | Collins et al. |
| 9,494,021 | B2 | 11/2016 | Parks et al. |
| 9,581,422 | B2 | 2/2017 | Preiss et al. |
| 9,605,937 | B2 | 3/2017 | Eitschberger et al. |
| 9,677,373 | B2 | 6/2017 | Harris |
| 9,702,680 | B2 | 7/2017 | Parks et al. |
| 9,719,339 | B2 | 8/2017 | Richard et al. |
| 9,784,549 | B2 | 10/2017 | Eitschberger |
| 9,810,035 | B1 | 11/2017 | Carr et al. |
| 9,822,596 | B2 | 11/2017 | Clemens et al. |
| 9,822,618 | B2 | 11/2017 | Eitschberger |
| 9,851,191 | B2 | 12/2017 | Lerche et al. |
| 9,903,185 | B2 | 2/2018 | Ursi et al. |
| 9,915,513 | B1 | 3/2018 | Zemla et al. |
| 9,951,589 | B2 | 4/2018 | Wilson |
| 10,036,236 | B1 | 7/2018 | Sullivan et al. |
| 10,066,921 | B2 | 9/2018 | Eitschberger |
| 10,188,990 | B2 | 1/2019 | Burmeister et al. |
| 10,309,199 | B2 | 6/2019 | Eitschberger |
| 10,309,952 | B2 | 6/2019 | Rudnik et al. |
| 10,352,136 | B2 | 7/2019 | Goyeneche |
| 10,352,674 | B2 | 7/2019 | Eitschberger |
| 10,365,078 | B2 | 7/2019 | Eitschberger |
| 10,365,079 | B2 | 7/2019 | Harrington et al. |
| 10,429,161 | B2 | 10/2019 | Parks et al. |
| 10,507,433 | B2 | 12/2019 | Eitschberger et al. |
| 10,557,693 | B2 | 2/2020 | Lerche et al. |
| 10,648,300 | B2 | 5/2020 | Collins et al. |
| 10,689,931 | B2 | 6/2020 | Mickey et al. |
| 10,794,122 | B2 | 10/2020 | Kitchen et al. |
| 10,844,678 | B2 | 11/2020 | Mickey et al. |
| 10,858,919 | B2 | 12/2020 | Anthony et al. |
| 10,890,036 | B2 | 1/2021 | Kosel et al. |
| 10,941,625 | B2 | 3/2021 | Mickey |
| 11,066,886 | B2 | 7/2021 | Mickey |
| 11,078,763 | B2 | 8/2021 | Anthony et al. |
| 11,371,305 | B2 | 6/2022 | Mickey et al. |
| 2003/0047358 | A1 | 3/2003 | Bonkowski |
| 2003/0196806 | A1 | 10/2003 | Hromas et al. |
| 2004/0134667 | A1 | 7/2004 | Brewer et al. |
| 2004/0216866 | A1 | 11/2004 | Barlow et al. |
| 2006/0060355 | A1* | 3/2006 | Bell ..... E21B 43/117 166/55 |
| 2008/0149338 | A1 | 6/2008 | Goodman et al. |
| 2010/0286800 | A1 | 11/2010 | Lerche et al. |
| 2011/0090091 | A1 | 4/2011 | Lerche et al. |
| 2012/0199352 | A1 | 8/2012 | Lanclos et al. |
| 2012/0247769 | A1* | 10/2012 | Schacherer ..... E21B 43/116 166/63 |
| 2012/0247771 | A1 | 10/2012 | Black et al. |
| 2012/0298361 | A1 | 11/2012 | Sampson |
| 2013/0008669 | A1 | 1/2013 | Deere et al. |
| 2013/0042780 | A1 | 2/2013 | Brooks et al. |
| 2013/0153205 | A1 | 6/2013 | Borgfeld et al. |
| 2013/0220613 | A1 | 8/2013 | Brooks et al. |
| 2013/0337635 | A1 | 12/2013 | Yamawaku et al. |
| 2014/0033939 | A1 | 2/2014 | Priess et al. |
| 2014/0151018 | A1 | 6/2014 | Lerche et al. |
| 2015/0292306 | A1 | 10/2015 | Collins et al. |
| 2015/0292849 | A1 | 10/2015 | Lerche et al. |
| 2015/0308795 | A1 | 10/2015 | Collins et al. |
| 2015/0322742 | A1 | 11/2015 | Brooks |
| 2015/0330192 | A1* | 11/2015 | Rogman ..... E21B 43/1185 166/297 |
| 2015/0337635 | A1 | 11/2015 | Langford et al. |
| 2015/0345916 | A1 | 12/2015 | Sokolove et al. |
| 2015/0345922 | A1 | 12/2015 | Lanclos et al. |
| 2016/0061572 | A1 | 3/2016 | Eitschberger et al. |
| 2016/0115753 | A1 | 4/2016 | Frazier et al. |
| 2016/0138394 | A1 | 5/2016 | Brooks et al. |
| 2016/0168961 | A1 | 6/2016 | Parks et al. |
| 2016/0281477 | A1 | 9/2016 | Langford et al. |
| 2016/0356132 | A1 | 12/2016 | Burmeister et al. |
| 2017/0030693 | A1 | 2/2017 | Preiss et al. |
| 2017/0074078 | A1 | 3/2017 | Eitschberger |
| 2017/0119016 | A1 | 5/2017 | Cook et al. |
| 2017/0121236 | A1 | 5/2017 | Bradley et al. |
| 2017/0122083 | A1 | 5/2017 | Wilson |
| 2017/0122086 | A1 | 5/2017 | Sheng |

(56) References Cited

U.S. PATENT DOCUMENTS

| | | | |
|---|---|---|---|
| 2017/0191328 | A1 | 7/2017 | Sokolove et al. |
| 2017/0198559 | A1 | 7/2017 | Golian et al. |
| 2017/0199015 | A1 | 7/2017 | Collins et al. |
| 2017/0199016 | A1 | 7/2017 | Collins et al. |
| 2017/0211363 | A1 | 7/2017 | Bradley et al. |
| 2017/0275976 | A1 | 9/2017 | Collins et al. |
| 2017/0314373 | A9 | 11/2017 | Bradley et al. |
| 2017/0370194 | A1 | 12/2017 | Lopez et al. |
| 2018/0038208 | A1 | 2/2018 | Eitschberger |
| 2018/0080298 | A1 | 3/2018 | Covalt et al. |
| 2018/0087330 | A1 | 3/2018 | Bradley et al. |
| 2018/0094910 | A1 | 4/2018 | Ashton et al. |
| 2018/0106121 | A1 | 4/2018 | Griffin et al. |
| 2018/0112500 | A1 | 4/2018 | Collins et al. |
| 2018/0216445 | A1 | 8/2018 | Collins et al. |
| 2018/0224260 | A1 | 8/2018 | Zemla et al. |
| 2018/0256724 | A1 | 9/2018 | Knipe et al. |
| 2018/0299239 | A1 | 10/2018 | Eitschberger et al. |
| 2018/0318770 | A1 | 11/2018 | Eitschberger et al. |
| 2018/0347324 | A1* | 12/2018 | Langford ..... H01R 13/08 |
| 2018/0347325 | A1* | 12/2018 | Goyeneche ..... E21B 43/11855 |
| 2019/0048693 | A1 | 2/2019 | Henke et al. |
| 2019/0085685 | A1 | 3/2019 | McBride |
| 2019/0086189 | A1 | 3/2019 | Eitschberger et al. |
| 2019/0106969 | A1 | 4/2019 | Sullivan et al. |
| 2019/0127290 | A1 | 5/2019 | Löhken et al. |
| 2019/0153827 | A1 | 5/2019 | Goyeneche |
| 2019/0162056 | A1* | 5/2019 | Sansing ..... F42D 1/055 |
| 2019/0162057 | A1 | 5/2019 | Ashton et al. |
| 2019/0178045 | A1 | 6/2019 | Frazier et al. |
| 2019/0195054 | A1 | 6/2019 | Bradley et al. |
| 2019/0219375 | A1 | 7/2019 | Parks et al. |
| 2019/0234189 | A1 | 8/2019 | Preiss |
| 2019/0242209 | A1 | 8/2019 | Anthony et al. |
| 2019/0242222 | A1 | 8/2019 | Eitschberger |
| 2019/0257158 | A1 | 8/2019 | Langford et al. |
| 2019/0309609 | A1 | 10/2019 | Hardesty et al. |
| 2019/0330947 | A1 | 10/2019 | Mulhern et al. |
| 2019/0368293 | A1 | 12/2019 | Covalt et al. |
| 2019/0376775 | A1 | 12/2019 | Preiss et al. |
| 2020/0024935 | A1 | 1/2020 | Eitschberger et al. |
| 2020/0032626 | A1 | 1/2020 | Parks et al. |
| 2020/0072029 | A1 | 3/2020 | Anthony et al. |
| 2020/0182025 | A1 | 6/2020 | Brady |
| 2020/0190927 | A1 | 6/2020 | Mickey et al. |
| 2020/0190928 | A1 | 6/2020 | King et al. |
| 2020/0199983 | A1 | 6/2020 | Preiss et al. |
| 2020/0200516 | A1 | 6/2020 | Zemla et al. |
| 2020/0256168 | A1 | 8/2020 | Knight et al. |
| 2021/0332678 | A1 | 10/2021 | Anthony et al. |

FOREIGN PATENT DOCUMENTS

| | | | |
|---|---|---|---|
| CN | 203742568 | U | 7/2014 |
| DE | 102006039096 | | 1/2008 |
| EP | 601880 | A2 | 6/1994 |
| GB | 2367574 | B | 2/2003 |
| GB | 2405423 | A | 3/2005 |
| GB | 2395969 | B | 11/2005 |
| WO | 1979000704 | A1 | 9/1979 |
| WO | 2015179787 | A1 | 11/2015 |
| WO | 2018112153 | A1 | 6/2018 |
| WO | 2022067212 | A1 | 3/2022 |

OTHER PUBLICATIONS

Dynaenergetics, DynaStage Perforating Gun System—Improve Wellsite Efficiency with a Truly Modular Design, downloaded from the world wide web, dated at least as early as Aug. 10, 2018, pp. 1-2.

Dynaenergetics, DynaStage Perforating Gun System, downloaded from the world wide web, dated at least as early as Aug. 10, 2018, pp. 1-2.

Dynaenergetics, Gun Assembly, downloaded from the world wide web, dated at least as early as Aug. 10, 2018, p. 1.

Hunting, 2014 Gun System and Accessories Catalog, downloaded from the world wide web, dated 2014, pp. 1-33.

Hunting, H-1 Perforating Gun System—H-1 Gun String—TCP and Gun String—Wireline, downloaded from the world wide web, dated at least as early as Aug. 10, 2018, pp. 1-2.

Hunting, H-1 Perforating Gun System—H-1 Gun String—TCP, downloaded from the world wide web, dated at least as early as Aug. 10, 2018, p. 1.

Hunting, H-1 Perforating Gun System—Titan Division Perforating Systems, downloaded from the world wide web, dated at least as early as Aug. 10, 2018, pp. 1-2.

Hunting, Marketing White Paper: H-1 Perforating Gun System, downloaded from the world wide web, dated Jan. 2017, pp. 1-5.

Schlumberger, ASFS Addressable-Switch Firing System, downloaded from the world wide web, dated at least as early as Aug. 10, 2018, p. 1.

Schlumberger, Fractal Flex, downloaded from the world wide web, dated at least as early as Aug. 10, 2018, p. 1.

Guardian, Addressable Release Tool Operations and Maintenance Manual, downloaded from the world wide web, dated at least as early as Oct. 5, 2011, pp. 1-210.

* cited by examiner

DOWNHOLE PERFORATING TOOL WITH INTEGRATED DETONATION ASSEMBLY AND METHOD OF USING SAME

CROSS-REFERENCE TO RELATED APPLICATIONS

The application is a continuation of U.S. Non-Provisional application Ser. No. 16/676,246 filed on Nov. 6, 2019, which is a continuation-in-part of U.S. Non-Provisional application Ser. No. 16/537,347 filed on Aug. 9, 2019, which claims the benefit of U.S. Provisional Application No. 62/717,320, filed on Aug. 10, 2018, the entire contents of which are hereby incorporated by reference herein to the extent not inconsistent with the present disclosure.

BACKGROUND

The present disclosure relates generally to oilfield technology. More specifically, the present disclosure relates to downhole tools with detonators.

Wells are drilled into subsurface formations to reach subsurface targets, such as valuable hydrocarbons. Drilling equipment is positioned at the surface and drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

Stimulation techniques have been developed to facilitate the production of fluid from the subterranean formation and into the wellbore. For example, some stimulation tools may be used for injecting and/or pumping fracturing fluids into the subterranean formation to form and/or expand fractures therethrough. Examples of injection tools are provided in U.S. Pat. No. 9,719,339, the entire contents of which is hereby incorporated by reference herein to the extent not inconsistent with the present disclosure.

In some cases, perforations may be formed along the wall of the wellbore and/or casing for passing the fracturing fluids therethrough. Some stimulation tools may be deployed into the wellbore to create perforations along a wall of the wellbore and into the subterranean formation. Examples of such tools are provided in U.S. Pat. Nos. 6,752,083; 6,752,083; EP0601880; U.S. Pat. Nos. 5,347,929; 5,042,594; 5,088,413; 9,605,937; and US20170314373, the entire contents of which are hereby incorporated by reference herein to the extent not inconsistent with the present disclosure. The perforations may be created by firing charges from the stimulation tool into the wall of the wellbore. See, for example, Patent/Application Nos. US20120199352; US20170211363, US20170275976; and US20180216445, the entire contents of which are hereby incorporated by reference herein to the extent not inconsistent with the present disclosure.

Despite the advancements in stimulation technology, there remains a need for safe, reliable, and efficient perforating tools. The present disclosure is directed at providing such needs.

SUMMARY

In at least one aspect, the present disclosure relates to a detonation assembly for a perforating unit of a downhole tool positionable in a wellbore penetrating a subterranean formation. The perforating unit comprises an outer housing connectable to the downhole tool. The detonation assembly comprises a detonator assembly and a charge assembly. The detonator assembly is positioned in the outer housing. The detonator assembly comprises a bulkhead connected to the outer housing; a charge connector connected to the bulkhead, the charge connection having a connection end; a detonator carried by the charge connector; and a trigger coupled to the detonator and to a remote actuator. The charge assembly is insertable into the outer housing. The charge assembly comprises a charge tube to support shaped charges therein; a charge feedthru at one end of the charge tube; and a receiver at an opposite end of the charge tube, the receiver having a receptacle shaped to matingly receive the connection end of the charge connector and to engage the trigger whereby, upon insertion of the charge assembly into the outer housing, the receiver is oriented and communicatively secured to the detonator assembly.

In another aspect, the disclosure relates to a perforating unit of a downhole tool positionable in a wellbore penetrating a subterranean formation. The perforating unit comprises an outer housing and a detonation assembly. The detonation assembly is positionable in the outer housing. The detonation assembly comprises a detonator assembly and a charge assembly. The detonator assembly is positioned in the outer housing. The detonator assembly comprises a bulkhead connected to the outer housing; a charge connector connected to the bulkhead, the charge connection having a connection end; a detonator carried by the charge connector; and a trigger coupled to the detonator and to a remote actuator. The charge assembly is insertable into the outer housing. The charge assembly comprises a charge tube to support shaped charges therein; a charge feedthru at one end of the charge tube; and a receiver at an opposite end of the charge tube. The receiver has a receptacle shaped to matingly receive the connection end of the charge connector and to engage the trigger whereby, upon insertion of the charge assembly into the outer housing, the receiver is oriented and communicatively secured to the detonator assembly.

Finally, in another aspect, the disclosure relates to a method of assembling a downhole perforating tool. The method comprises assembling the detonation assembly, connecting the outer housing to the downhole tool, and establishing a communication link between the detonator and a surface receiver. The detonation assembly may be assembled by: connecting the bulkhead of the detonator assembly to the outer housing; and connecting the detonator assembly to the charge assembly by inserting the charge assembly in the outer housing while receiving the connection end of the charge connector into the receiver;

In at least one aspect, the present disclosure relates to a detonator assembly for a perforating unit of a downhole tool positionable in a wellbore penetrating a subterranean formation. The detonator assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing. The trigger comprises a detonation switch and a detonator contact, the detonation switch communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The first connector is connectable to another perforating unit of the downhole tool. The first connector comprises a bulkhead and a feedthru. The first connector is electrically connected to the detonation switch. The bulkhead is electrically connected to the detonator switch by a spring-loaded pin. The bulkhead is electrically connectable to the feedthru and the feedthru is electrically connectable to another perforating unit of the downhole tool. The second connector comprises an insert portion insertable into an opening of the detonation housing and an offset portion extending from the insert portion receivably positionable into a mated receptacle in a charge assembly of the perforating unit.

The openings in the second connector are positioned along a flat surface of the offset portion. The flat surface is positionable against a corresponding flat surface of the mated receptacle of the charge assembly. The detonator contact comprises a spring portion and a support portion, the support portion having a curved portion shaped to receive the detonator and a flat portion extending therefrom, the spring portion having spring-loaded arms in the flat portion thereof. The spring-loaded arms have an engagement portion coupled to the flat portion and engageable with a charge assembly of the perforating unit and a tip extending from the engagement portion for connection to the detonation switch. The trigger further comprises a plug and switch contacts. The first connector comprises a bulkhead and a feedthru.

In another aspect, the disclosure relates to a downhole tool positionable in a wellbore penetrating a subterranean formation. The downhole tool comprises a tool housing positionable in the wellbore and at least one perforating unit positionable in the tool housing. Each of the perforating units comprises a perforating housing; a charge assembly positioned in the perforating housing; and a detonator assembly positioned in the perforating housing. The charge assembling has a charge chamber with shaped charges releasably supported therein. The detonator assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing. The trigger comprises a detonation switch and a detonator contact, the detonation switch communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The charge assembly comprises a charge tube, a receiver, and a charge feedthru. The charge feedthru is electrically connectable with the detonator assembly. The charge feedthru comprising a locking cap, plunger, retainer, and end plate. The detonator contact has an asymmetric end positionable in the receiver. The receiver comprises a detonation link defining a detonator receptacle in the receiver. The detonator receptacle shaped to matingly receive (i.e. mate with) the asymmetric end and the detonation link having a contact surface engageable with the electrical contacts. The downhole tool further comprises a retainer, a support sub, and/or a conveyance connector.

Finally, in another aspect, the disclosure relates to a method of assembling a downhole tool. The method comprises assembling a detonator assembly; assembling a charge assembly; providing a tool housing; positioning the charge assembly in the tool housing; positioning the detonator assembly in the tool housing; and electrically connecting the detonator assembly with the charge assembly.

In another aspect, the detonator assembly is for a perforating unit of a downhole tool positionable in a wellbore penetrating a subterranean formation, and the perforating unit also including a charge assembly. The detonator assembly comprises a detonator housing positionable within the perforating unit, the detonator housing having an uphole end and a downhole end; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprises a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

The uphole connector is connectable to a second perforating unit of the downhole tool, the uphole connector comprises a bulkhead and a feedthru, and the uphole connector is electrically connected to the detonation switch. The bulkhead is electrically connected to the detonator switch by a spring-loaded pin. The bulkhead is electrically connectable to the feedthru and the feedthru is electrically connectable to a third perforating unit of the downhole tool. The downhole connection comprises an insert portion insertable into an opening of the detonation housing and an asymmetrical portion extending from the insert portion, the asymmetrical portion receivably positionable into a mated receptacle in the charge assembly. The openings are positioned along a flat surface of the asymmetrical portion, the flat surface positionable against a corresponding flat surface of the mated receptacle of the charge assembly. The detonator contact comprises a spring portion and a support portion, the spring and support portions each having a curved portion shaped to receive the detonator and a flat portion extending therefrom, the spring portion having the spring-loaded arms in the flat portion thereof. The flat portions of each of the spring and support portions are positionable adjacent to each other, the spring-loaded arms having an engagement portion coupled to the flat portion and engageable with the flat surface of the charge assembly and a support tip extending from the engagement portion for engagement with the flat portion of the support portion whereby the engagement portion is urged against the flat surface of the charge assembly. The trigger further comprises a plug and contacts electrically connectable between the detonator switch and the detonator contact. The uphole connector comprises a bulkhead and a feedthru, the bulkhead having a slotted lock, the feedthru having a mated pin engageable with the slotted lock.

In another aspect, the disclosure relates to a downhole tool positionable in a wellbore penetrating a subterranean formation. The downhole tool comprises a tool housing positionable in the wellbore; and at least one perforating unit positionable in the housing. Each of the at least one perforating units comprises a perforating housing; a charge assembly positioned in the perforating housing, the charge assembly having a charge chamber with shaped charges releasably supported in the charge chamber; and a detonator assembly positioned in the perforating housing. The detonator assembly comprises a detonator housing having an uphole end and a downhole end and positionable in the perforating housing; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprising a detonation switch and a detonator contact, the detonation switch communicatively coupled, when in use, between a remote actuator and the detonator contact, the detonator contact positionable in the downhole connection, the detonator contact having spring-loaded arms extending through openings in the downhole connection to urge electrical contact with the charge assembly whereby an electrical connection is maintained between the detonator and the charge assembly.

The charge assembly comprises a charge tube, a receiver, and a charge feedthru. The charge feedthru is electrically connectable with the detonator feedthru, the charge feedthru comprising a locking cap, plunger, retainer, and end plate. The detonator contact has an asymmetric end positionable in the receiver, the receiver comprising a detonation link defining a detonator receptacle in the receiver, the detonator receptacle shaped to matingly receive the asymmetric end and the detonation link having a contact surface engageable with the electrical contacts. The downhole tool of claim 11, further comprising a retainer, a support sub, and/or a conveyance connector.

Finally, in another aspect, the disclosure relates to a method of assembling a downhole tool. The method comprises assembling a detonator assembly as in claim 1; assembling a charge assembly; providing a tool housing; positioning the charge assembly in the tool housing; positioning the detonator assembly in the tool housing; and electrically connecting the detonator assembly with the charge assembly.

The method further comprises positioning a second perforating unit in the tool housing and connecting the uphole connector to the second perforating unit. The uphole connector comprises a bulkhead and a feedthru, and the method further comprises electrically connecting the uphole connector to the detonation switch.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

This disclosure relates to a denotation assembly of a downhole perforating tool positionable in a wellbore at a wellsite. The perforating tool is provided with one or more perforating units, each perforating unit including an outer housing and a detonation assembly. The detonation assembly includes a charge assembly and a detonator assembly secured in the outer housing. The perforating units have quick-locking features to facilitate assembly and operation of the perforating tool and its detonator.

The charge and detonator assemblies are provided with quick-locking features for quick, one-way, redundant, and secure assembly and operation. For example, the charge and detonator assemblies may have one-way pin and guide (e.g., slot) locking mechanisms (with or without additional locks) for securing the components in place. In another example, the charge and detonator assemblies may have components shaped for one-way insertion into and/or connection with adjacent components to assure proper positioning and fit of the components.

In yet another example, the charge and detonator assemblies may have locking contacts with push-in place dual spring activation and redundant contact surfaces for maintaining a communication connection with the detonator and/or between the detonator assembly and the charge assembly for the passage of signals therebetween. The communication links and/or connections may be or include various communication components, such as wires, cables, plates, contacts, switches, plugs, and/or other features, capable of passing electrical, power, and/or other signals.

The present disclosure seeks to provide features capable of providing one or more of the following, among others: means for signal communication (e.g., electrical connection), push in place assembly, spring loaded contact, redundant components and/or contacts, mechanisms to assure good electrical contact, reliable communication and/or operation, pre-assembly and/or offsite assembly capabilities, snap on electrical connections, quick connections and/or locks, no requirement for soldering and/or crimping contacts, reliability, time savings, low maintenance costs, etc.

Figure 1:
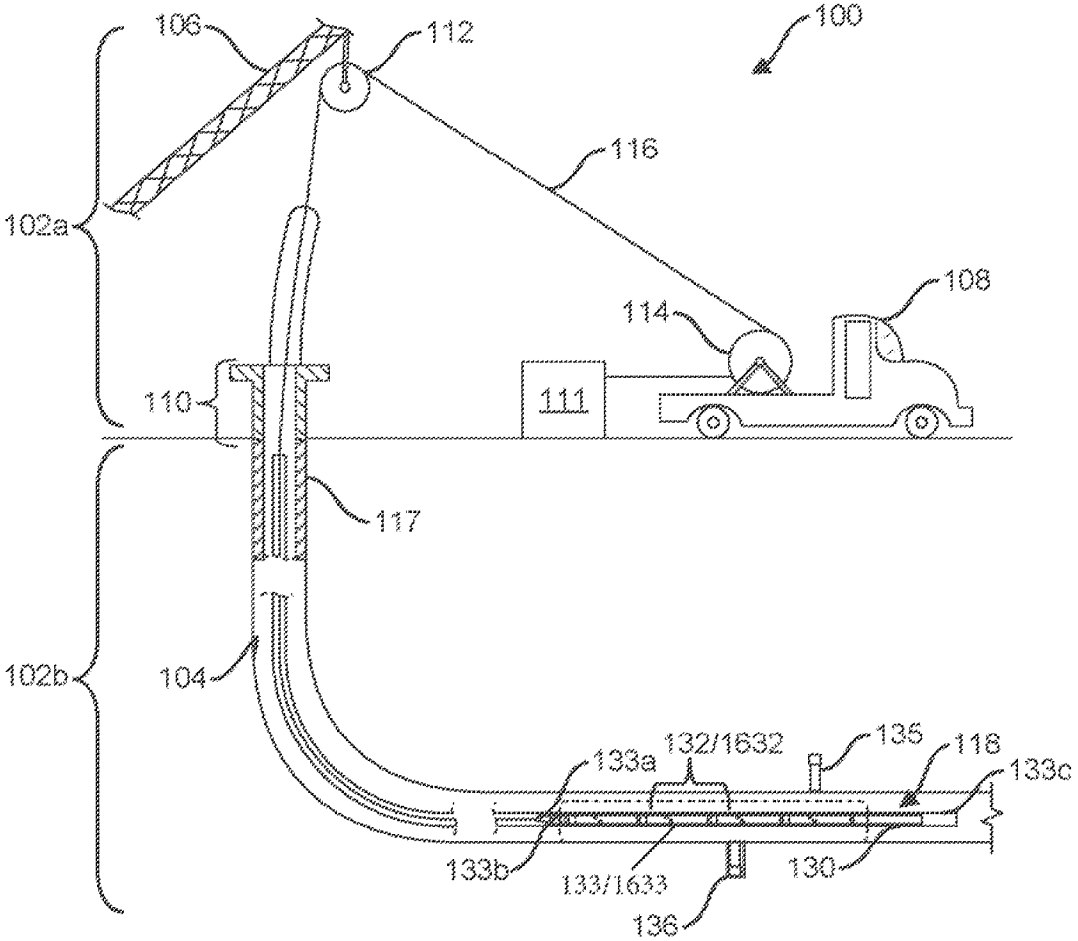
FIG. 1 is a schematic diagram depicting a wellsite with surface and downhole equipment, the downhole equipment comprising a downhole perforating tool having a quick-locking detonator assembly.

FIG. 1 is a schematic diagram depicting a wellsite 100 with surface equipment 102*a* and downhole equipment 102*b* positioned in a wellbore 104. The downhole equipment 102*b* comprises a downhole tool 118 with a perforating unit 132 having a quick-locking detonator assembly 133 or an integrated detonation assembly 1633 as is described further. The downhole tool 118 may be any downhole tool usable in the wellbore 104. When in combination with the perforating unit 132, the downhole tool 118 is referred to as a downhole perforating tool.

The wellsite 100 may be any wellsite positioned about a subterranean formation, such as an unconventional formation (e.g., shale) with a reservoir (e.g., oil, gas, water) therein. The surface equipment 102*a* includes a crane 106, a truck 108, a wellhead assembly 110, and a surface unit 111. The crane 106 supports a pulley 112. The truck 108 supports a spool 114. A conveyance (e.g., wireline) 116 extends from the spool 114 over the pulley 112 and into the wellbore 104. The surface unit 111 is coupled to the conveyance 116 for communication therewith.

Figure 2:
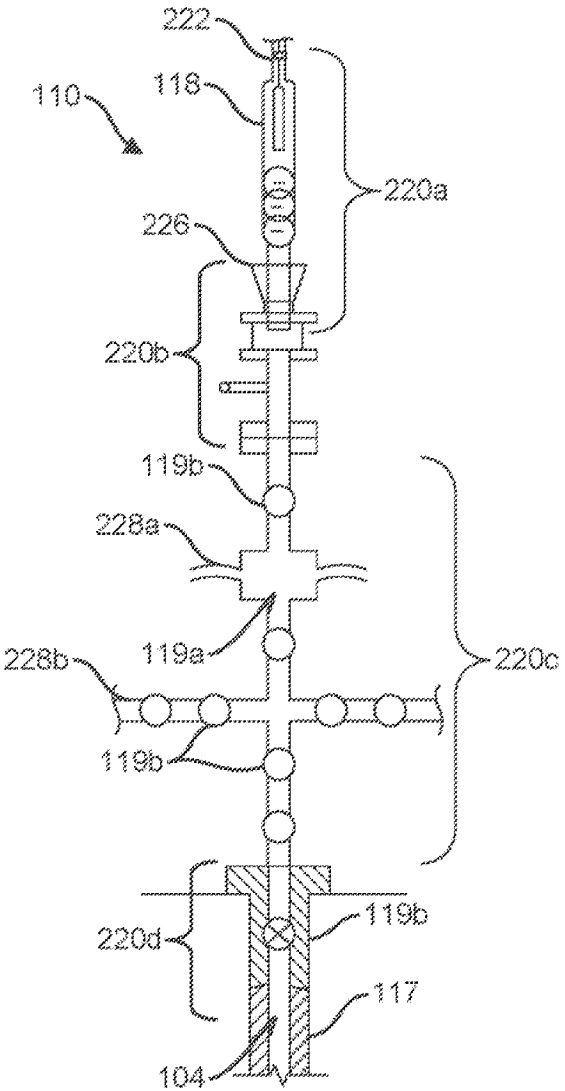
FIG. 2 is a schematic diagram depicting the surface equipment of FIG. 1 in greater detail.

The wellhead assembly 110 is disposed at a surface opening of the wellbore 104. An example wellhead assembly 110 is shown in FIG. 2. The wellhead assembly 110 includes a wireline lubricator 220*a*, a hydraulic disconnect 220*b*, a frac tree 220*c*, and a wellhead 220*d*. Portions of the wellhead assembly 110 are connectable to pressure control equipment (not shown) for the passage of fluids and/or to control pressures at the wellsite 100. A passage 119*a* extends through the wireline lubricator 220*a*, the hydraulic disconnect 220*b*, the frac tree 220*c*, and the wellhead 220*d* for fluid communication with the wellbore 104. Valves 119*b* are positioned about the wellhead assembly 110 to controllably restrict passage of fluid through portions thereof.

The wireline lubricator 220*a* is positioned at an upper end of the wellhead assembly 110 and is receivably supported in the hydraulic disconnect 220*b*. Seals 222 are positioned at an upper end of the wireline lubricator 220*a* for fluid isolation within the wellhead assembly 110. The wireline lubricator 220*a* may be detached from the wellhead assembly 110 and carried by the crane 106 for placement in the hydraulic disconnect 220*b*.

The hydraulic disconnect 220*b* includes a tulip 226 at an upper end to receive the wireline lubricator 220*a*. The hydraulic disconnect 220*b* is supported between the wireline lubricator 220*a* and the frac tree 220*c*. Once the wireline lubricator 220*a* is positioned in the tulip 226, the valves 119*b* on the hydraulic disconnect 220*b* may be opened to pass fluid therethrough or closed to isolate the passage therein. A lower end of hydraulic disconnect 220*b* is connectable to an upper end of the frac tree 220*c*. The frac tree 220*c* includes a goat head 228*a* and a cross member 228*b*. A lower end of the frac tree 220*c* is connectable to the wellhead 220*d*.

Referring back to FIG. 1, the downhole equipment 102*b* includes a casing 117 positioned in the wellbore 104 and the downhole tool 118 supported in the wellbore 104 by the conveyance 116. The casing 117 is a tubular member that lines the wellbore 104 and is connected to the wellhead 220*d*. Note that in some embodiments the casing 117 may be omitted (e.g., for openhole applications), or the casing 117 may be installed in only a portion of the wellbore 104.

The downhole tool 118 may be a downhole perforating tool or other downhole tool disposable in the wellbore 104 capable of carrying a perforating unit 132 for perforating the wellbore 104 as is described further herein.

Quick Locking Detonator Assembly

Figure 3:
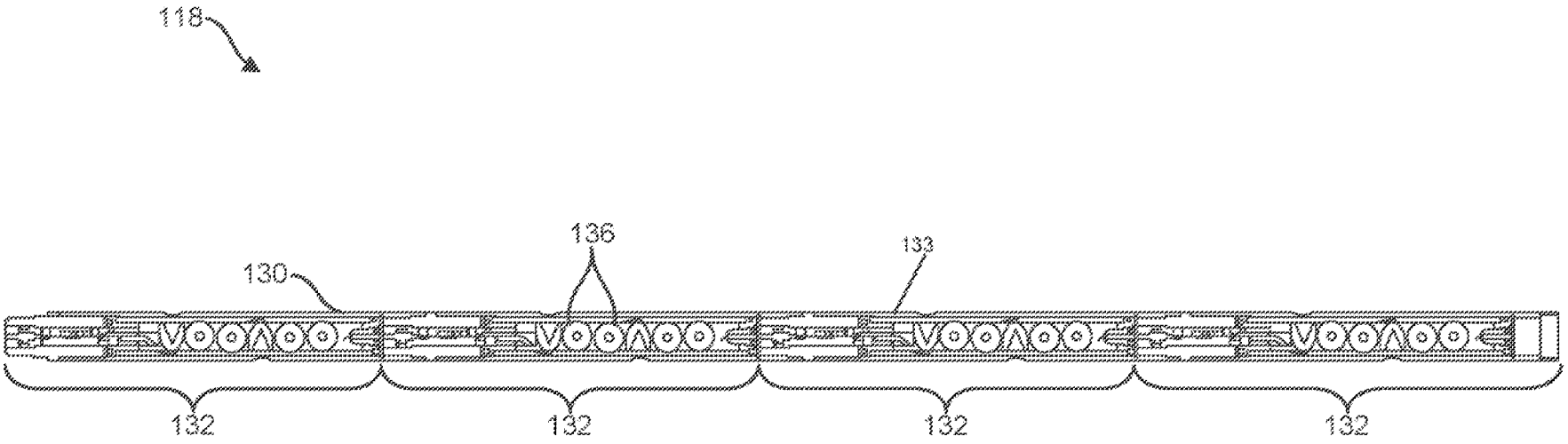
FIG. 3 is a longitudinal, cross-sectional view of a portion of the downhole perforating tool comprising a plurality of perforating units.

FIGS. 3-15 depict aspects of the quick locking detonation assembly 133 usable with the perforating units 132 of FIG. 1. Referring to FIGS. 1 and 3, the downhole tool 118 comprises a housing 130 with a series of the perforating units 132 therein. The housing 130 is a tubular member positionable in the wellbore 104 by the conveyance 116, and is shaped to receivably support each of the perforating units 132 therein. The perforating units 132 are connected together end to end in series. Threaded connections may be provided at each end of the perforating units 132 for connecting one or more perforating units 132 together. In the illustrated embodiment, there are four perforating units 132, but other embodiments may employ different numbers of perforating units 132. Some embodiments may use as few as one perforating unit 132.

The perforating units 132 are positioned in the housing 130 and carry the detonation assembly 133. The detonation assembly 133 carries shaped charges 136. The shaped charges 136 are explosive components that form a focused radially-oriented jet when activated. This jet makes a perforation 135 that extends through the wall of the wellbore 104 (and the casing 117 and cement if present) and into the subterranean formation surrounding the wellbore 104. The shaped charges 136 may be configured to create the perforations 135 for passage of fracturing (or injection) fluid into the formation for hydraulic fracturing therein.

The perforating units 132 may be communicatively connected to the surface unit 111 by the wireline 116 and/or by other means (e.g., wireline, electromagnetic, sonar, or other communication means). The perforating units 132 may be independently operated, or communicatively linked together for integrated operation therebetween. A communication link (e.g., wire or cable, not separately shown) may extend from the wireline 116 through the housing 130 and/or the perforating units 132. The perforating units 132 may be connected by the communication link for communication therebetween and/or for communication with the other components of the downhole tool 118.

The downhole tool 118 may be provided with various components, such as a conveyance connector 133*a*, a collar locator ("CCL") 133*b*, and a plug-setting tool 133*c*, all shown in FIG. 1. The conveyance connector 133*a* may be provided at a first end of the downhole tool 118 for connection to the wireline 116. The plug setting tool 133*c* may secure the downhole tool 118 at specified depths along the wellbore 104.

The downhole tool 118 and/or one or more of the perforating units 132 may be coupled via a wired or wireless connection to the surface unit 111 as described above for operation therewith. The perforating unit(s) 132 may be activated by the surface unit 111 to selectively fire one or more of the shaped charges 136 to form the perforations 135 as schematically depicted in FIG. 1.

During operation, the downhole tool 118 may be carried in the wireline lubricator 220*a* via the wireline 116 to the wellsite 100 with the crane 106. Once the wireline lubricator 220*a* is secured in the tulip 226, the valve 119*b* of the hydraulic disconnect 220*b* may be opened to pump fluid to push the downhole tool 118 through the wellhead assembly 110 and into the wellbore 104. Fluid beneath the downhole tool 118 may be pumped back to the surface or exited out the wellbore 104 via pre-existing perforations (not shown) in the casing 118 to avoid the need for the fluid to return to the surface.

The CCL 133*b* may communicate an electrical signal up the wireline 116 to the surface unit 111 as it passes between adjacent segments of the casing 117. A position of the downhole tool 118 may be determined by counting these signals as the perforating system is pumped down the wellbore and by knowing the length of each segment of casing 117. However, other embodiments may use other techniques for determining the location of the CCL 133*b* in the wellbore 104.

When the bottom (i.e. downhole end) of the downhole tool 118 is at a desired position above the perforations 135 that are closest to the surface, pumping may be terminated. A coded communication signal may be sent down the wireline 116 to activate the plug-setting tool 133*c* to lock the downhole tool 118 in position. The signal may also be used to activate a switch in the perforating unit 132 to activate the perforating unit 132 to fire as is described further herein. Once fired, the plug-setting tool 133*c* may be activated to disconnect the downhole tool 118 and move the perforating tool 118 to another location, or out of the wellbore 104.

Figure 4A:
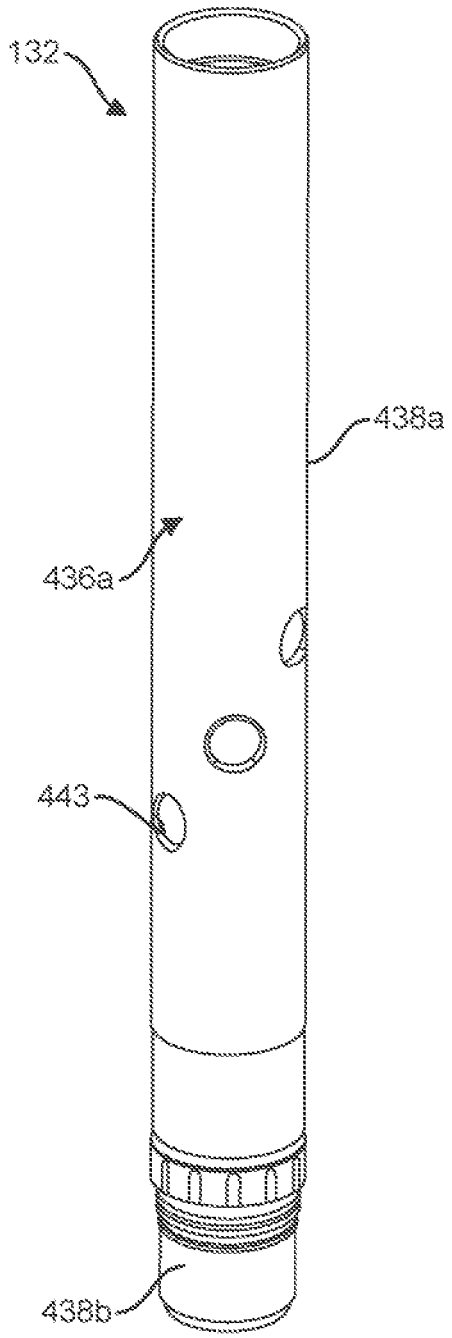
FIGS. 4A and 4B are perspective and longitudinal, cross-sectional views of one of the perforating units.
Figure 4B:
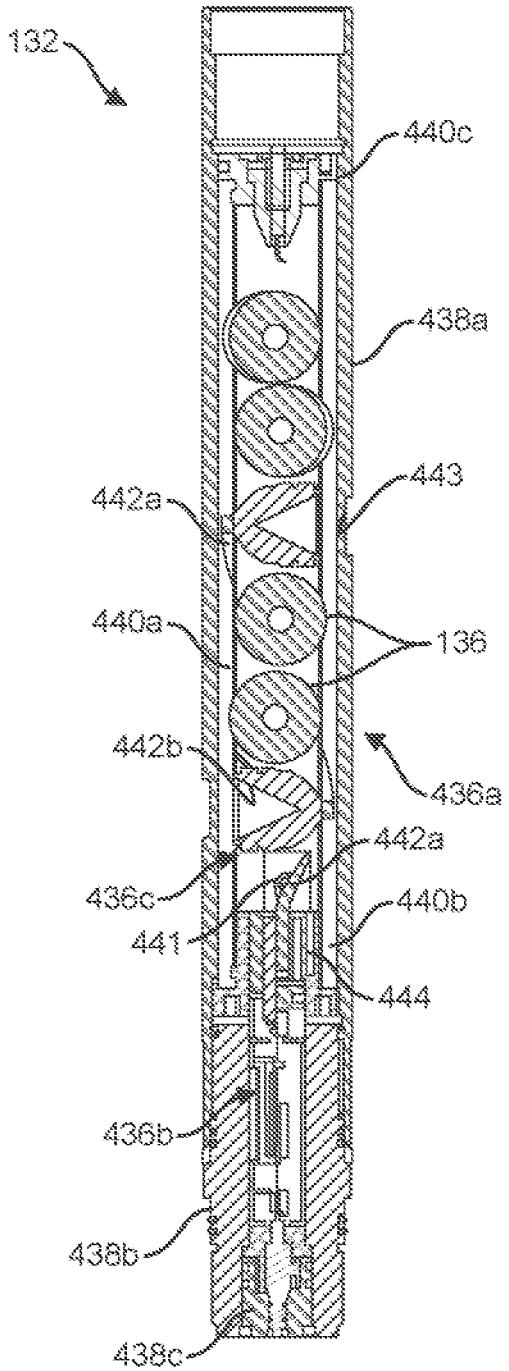
Figure 5:
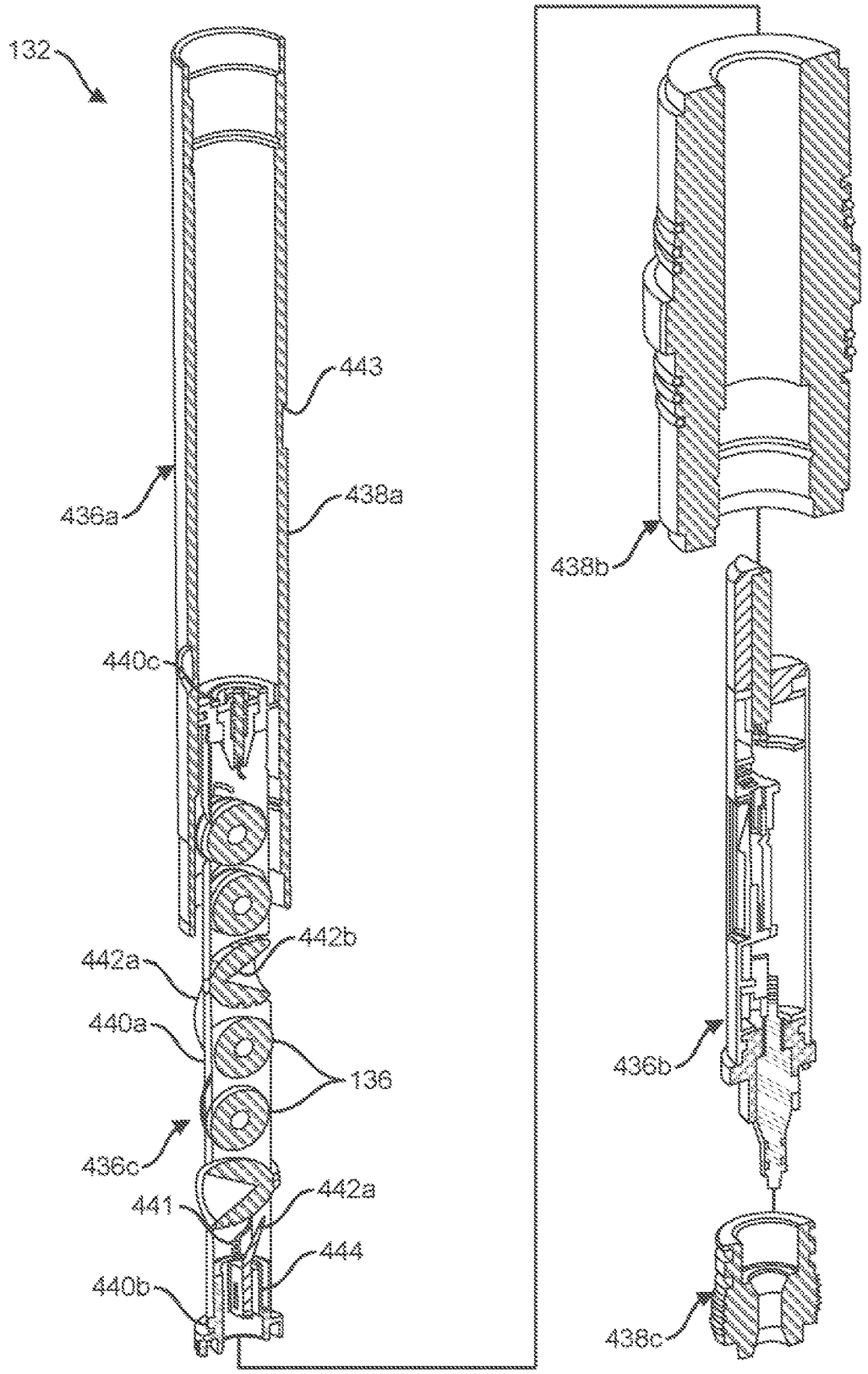
FIG. 5 is a cross-sectional, exploded view of the perforating unit.

FIGS. 4A-5 show one of the perforating units 132 in greater detail. FIGS. 4A and 4B show perspective and longitudinal, cross-sectional views of the perforating unit 132. FIG. 5 shows a cross-sectional, exploded view of the perforating unit 132. As shown in these views, the perforating unit 132 includes a perforating housing 436*a*, and the detonation assembly 133. The detonation assembly 133 includes a detonator assembly 436*b*, and a charge assembly 436*c*.

The perforating housing 436*a* includes an outer tube 438*a*, a support sub 438*b*, and a retainer 438*c*. The outer tube 438*a* is a tubular member slidingly receivable in the housing 130 (shown in FIG. 3). The outer tube 438*a* is shaped to receive the charge assembly 436*c* therein. The outer tube 438*a* has an end shaped to receive the support sub 438*b* and an opposite end shaped for connection to another perforating unit 132. The support sub 438*b* has an end insertable into the opposite end of the outer tube 438*a* and threadedly connected therewith. The support sub 438*b* also has another end extending from the outer tube 438*a* for connection to an adjacent perforating unit 132.

The support sub 438*b* is a tubular member shaped to support the retainer 438*c* and the detonator assembly 436*b*. The retainer 438*c* is positioned in an end of the support sub 438*b* to secure the detonator assembly 436*b* in the perforator housing 436*a*. The detonator assembly 436*b* is positioned in the support sub 438*b* and extends from the retainer 438*c* a distance into the charge assembly 436*c* for operative connection therewith as is described further herein.

Each of the perforating units 132 is provided with a communication link (e.g., wire) 441 extending therethrough for activating the detonator assembly 436*b* to fire the shaped charges 136. The communication link 441 may be a wire extending from the detonator assembly 436*b* through the charge tube 440*a* and to the charge feedthru 440*c*. The perforating units 132, where multiple perforating units 132 are employed, are connected in series with the communication link 441 coupled therebetween for selective activation of one or more of the perforating units 132. The communication link 441 of each perforating unit 132 may be coupled to an adjacent perforating unit 132 at each end of the perforation unit via the detonator assembly 436*b* at one end and the charge feedthru 440*c* at the other end for communication therewith. This connection may be repeated between the perforating units 132 to provide a series of connections for communication across the perforating units 132.

Figure 6A:
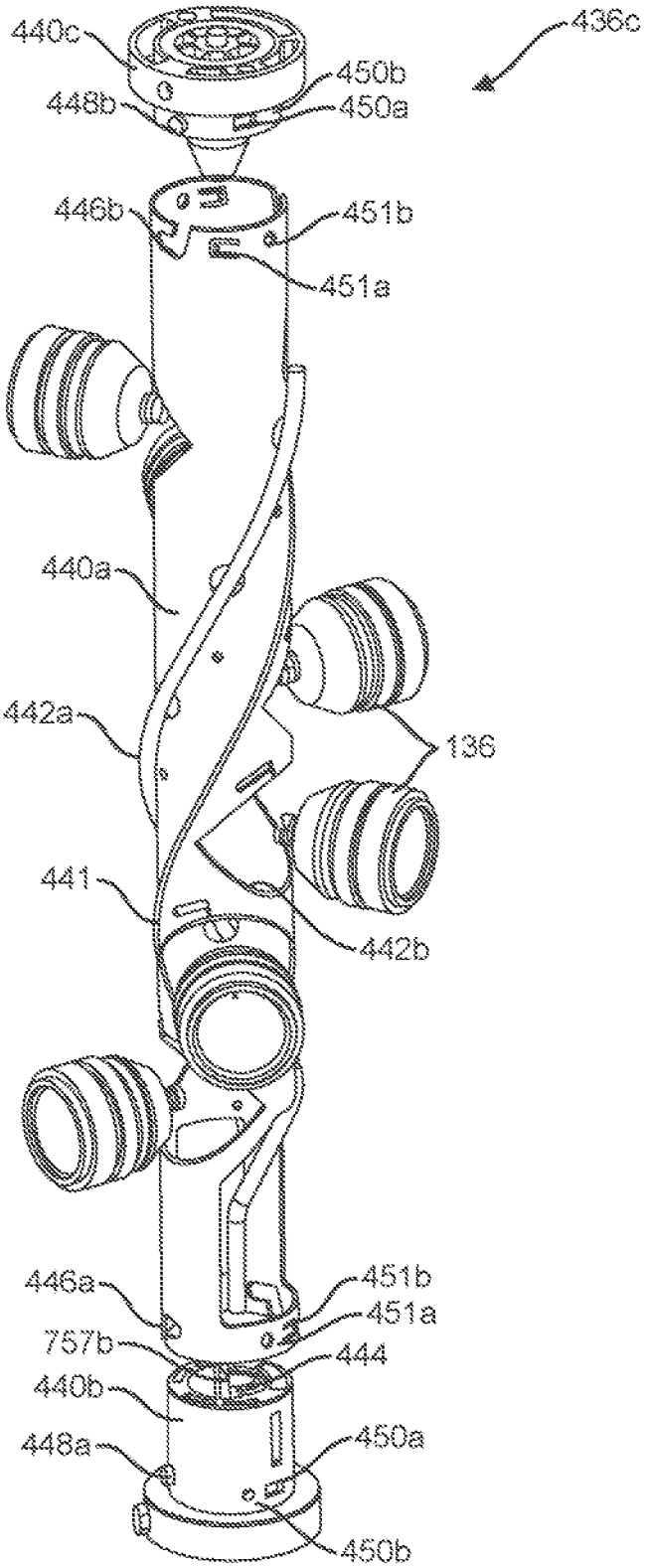
FIGS. 6A and 6B are exploded and partial cross-sectional views, respectively, of a charge assembly of the perforating unit.
Figure 6B:
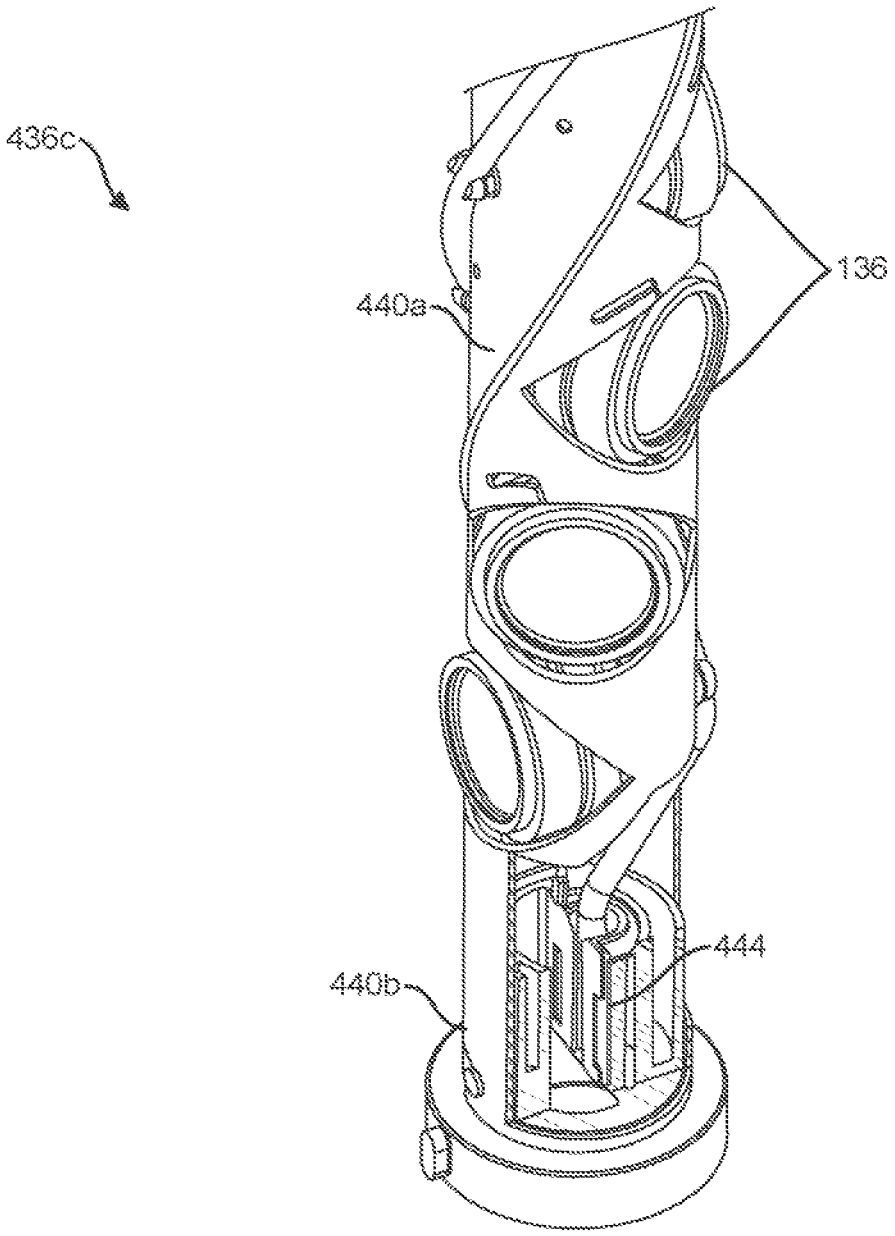
Figure 7:
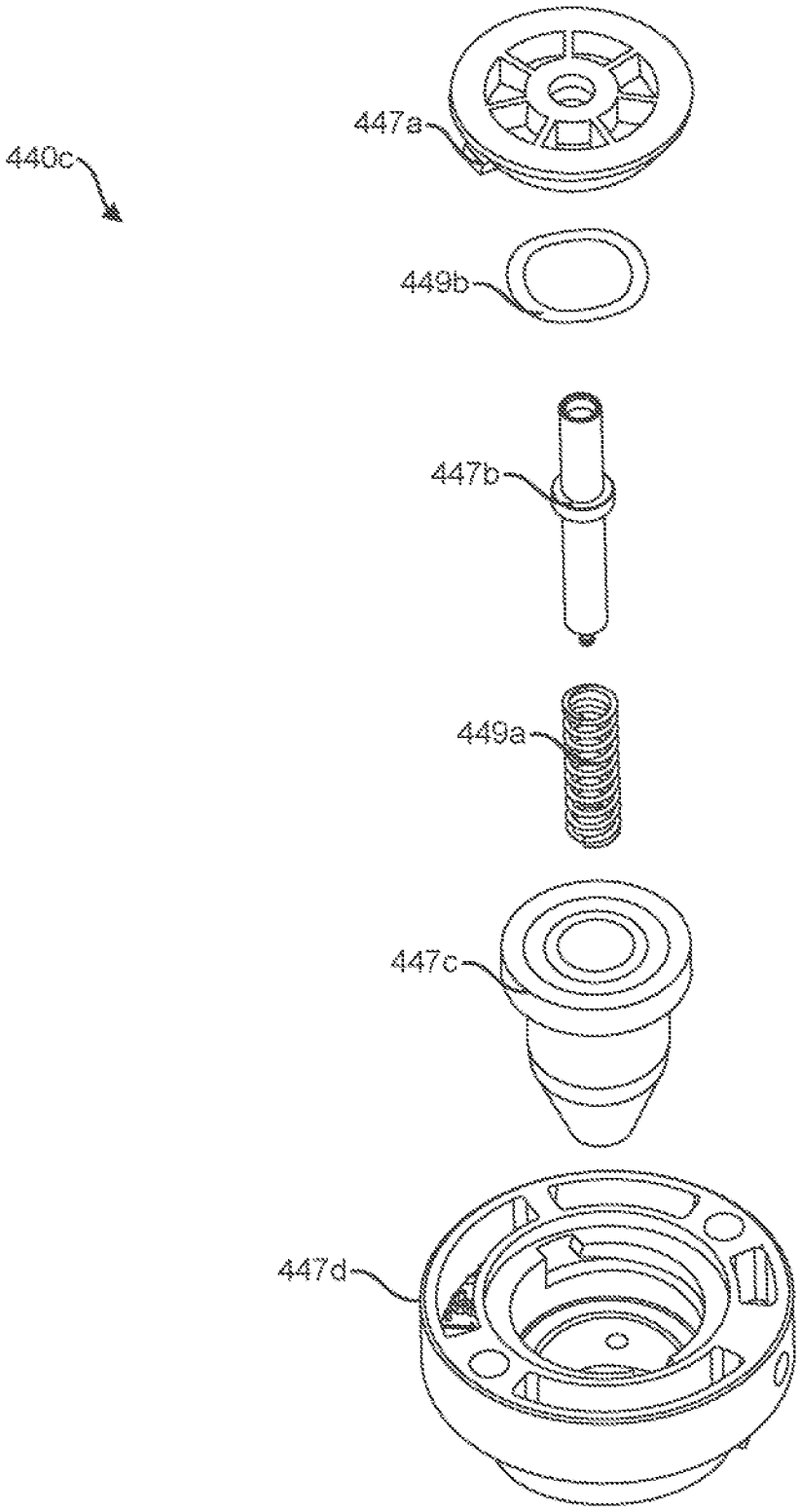
FIG. 7 is an exploded view of a charge feedthru of the charge assembly.

Referring to FIGS. 6A-6B, and 7 (as well as FIGS. 4B-5), features of the charge assembly 436*c* are shown. FIGS. 6A and 6B are exploded and partial cross-sectional views, respectively, of a charge assembly 436*c* of the perforating unit 132. FIG. 7 is an exploded view of a charge feedthru 440*c* of the charge assembly 436*c*.

The charge assembly 436*c* includes a charge tube 440*a*, a receiver 440*b* at one end of the charge tube 440*a*, and the charge feedthru 440*c* at an opposite end of the charge tube 440*a*. The charge tube 440*a* is slidingly receivable in the outer tube 438*a*. The charge tube 440*a* has the shaped charges 136 supported therein. The charge tube 440*a* also has a charge cable 442*a* and ports 442*b*.

The receiver 440*b* may be a flange shaped member receivable about an end of the charge tube 440*a* for connection to the support sub 438*b*. The receiver 440*b* may also be provided with a charge receptacle 444 shaped to receive the end of the detonator assembly 436*b* for connection therewith. The charge cable (or detonator cord) 442*a* is a fuse connected to the receiver 440*b*. The charge cable 442*a* extends from the receptacle 444 through the charge tube 440*a* and along a periphery of the charge tube 440*a* in a spiral configuration.

The charge cable 442*a* is connected to each of the shaped charges 136 in the charge tube 440*a* for activation thereof. The ports 442*b* extend through the charge tube 440*a*. The shaped charges 136 are positioned about the ports 442*b* to fire jets therethrough upon detonation. The ports 442*b* may be alignable with openings 443 in the perforating housing 436*a* for firing therethrough upon detonation.

The charge feedthru 440*c* is positionable at an opposite end of the charge tube 440*a* from the receiver 440*b*. As shown in greater detail in FIG. 7, the feedthru 440*c* includes a locking cap (or plate) 447*a*, plunger 447*b*, retainer 447*c*, and end plate 447*d*. The end plate 447*d* is seated on the locking cap 447*a*. The plunger 447*b* is supported on the locking cap 447*a* and extends through the end plate 447*d*. The plunger 447*b* is supported on the locking cap 447*a* and extends through the retainer 447*c*. Springs 449*a, b* may optionally be provided to support the plunger 447*b* in the retainer 447*c*.

As shown in FIGS. 4B and 6A, the charge tube 440*a*, the receiver 440*b*, and the feedthru 440*c* may have quick-locking features for lockingly connection in a desired position. In the example shown, the charge tube 440*a* is provided with guide slots 446*a, b* at each end shaped to matingly receive keys 448*a, b* positioned on the receiver 440*b* and the feedthru 440*c*, respectively.

When inserted into the end of the charge tube 440*a*, the key 448*a* of the receiver 440*b* is slidingly receivable into the guide slot 446*a*. The receiver 440*b* may be rotated so that the key 448*a* passes into the guide slot 446*a*, thereby positioning the receiver 440*b* in the desired position while also preventing unintentional retraction of the receiver 440*b* out of the charge tube 440*a*.

The charge tube 440*a* may also be provided with a locking tabs 451*a* and fastener holes 451*b* to secure the receiver 440*b* and feedthru 440*c* in position. The locking tabs 451*a* may be a cutout portion of the charge tube 440*a* corresponding to tab cavity 450*a* in the receiver 440*b* and the feedthru 440*c*. When the receiver 440*b*/the feedthru 440*c* are in position, the corresponding locking tab 451*a* may be pressed into the tab cavity 450*a* thereby further preventing movement of the receiver 440*b*/feedthru tube 440*c* about the charge tube 440*a*. Fasteners (not shown), such as pins, screws, bolts, etc., may be passed through fastener hole 451*b* and into a mated hole 450*b* in the receiver 440*b*/feedthru tube 440*c* to secure the receiver 440*b*/feedthru 440*c* to the charge tube 440*a*.

Figure 8A:
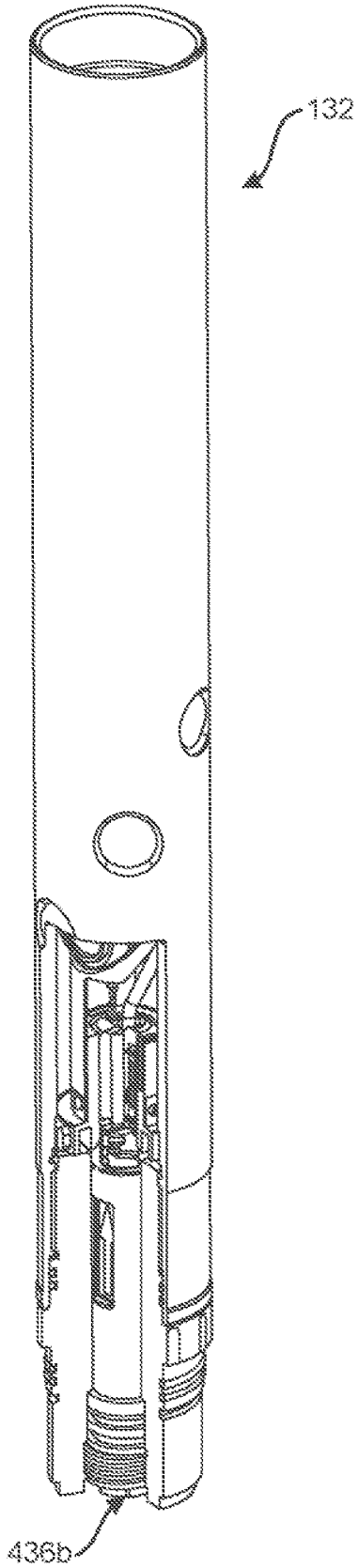
FIGS. 8A-8C are partial cross-sectional views of the perforating unit depicting a detonation assembly therein.
Figure 8B:
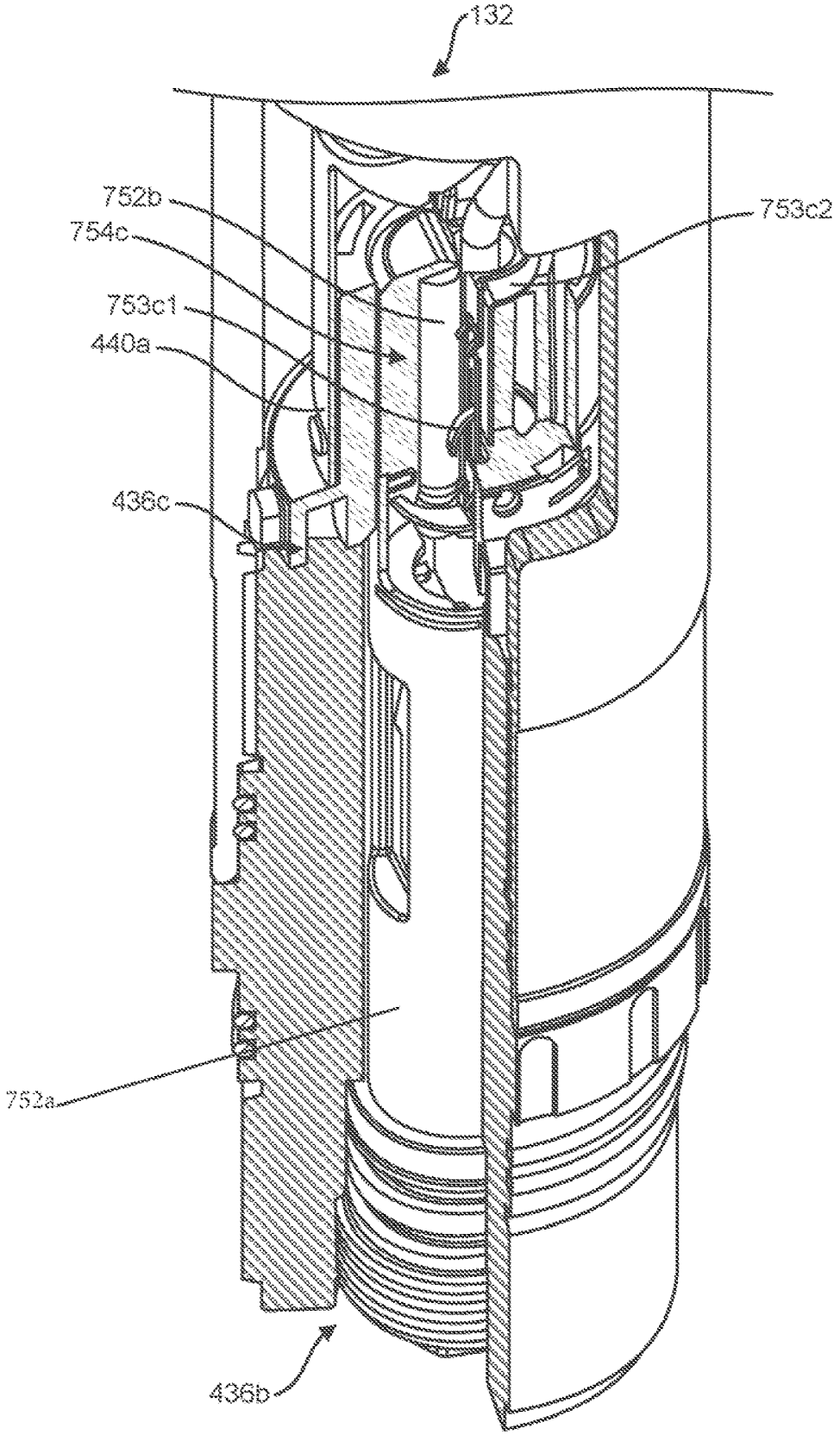
Figure 8C:
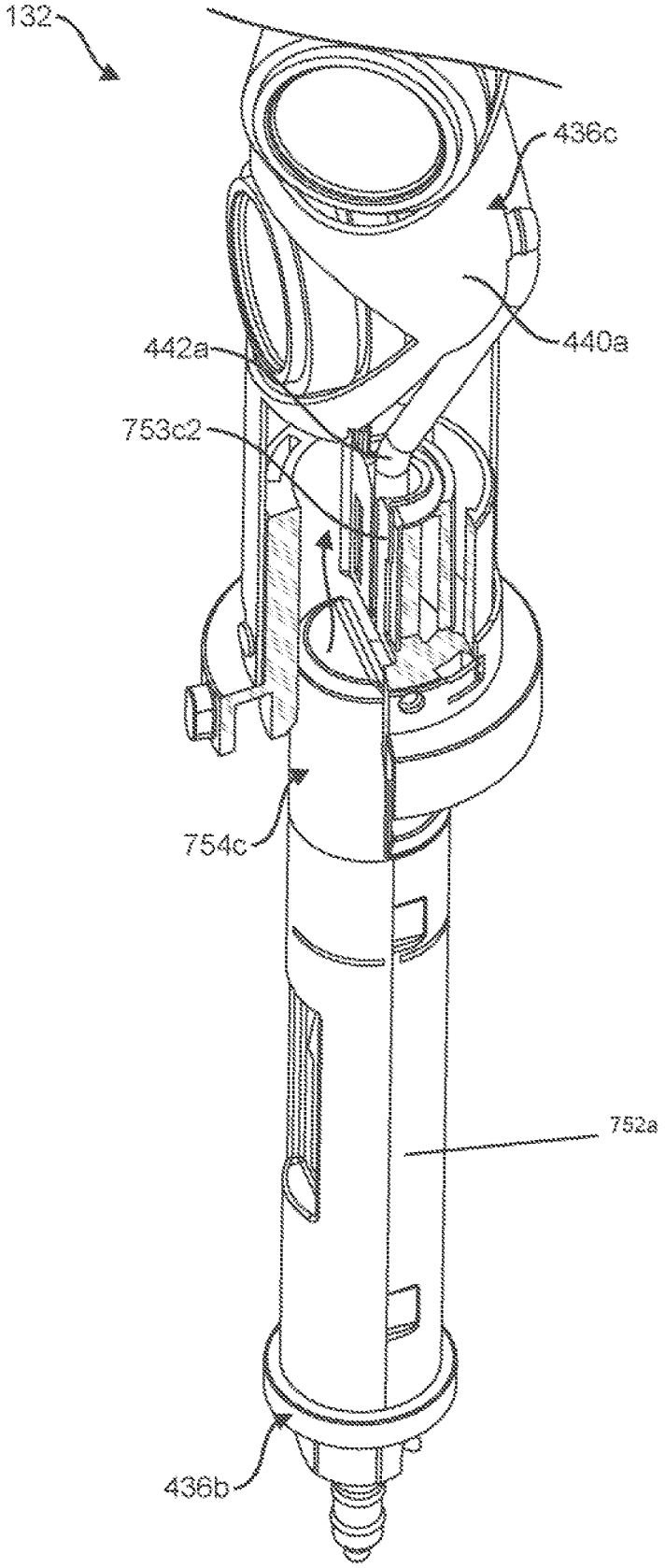
Figure 9:
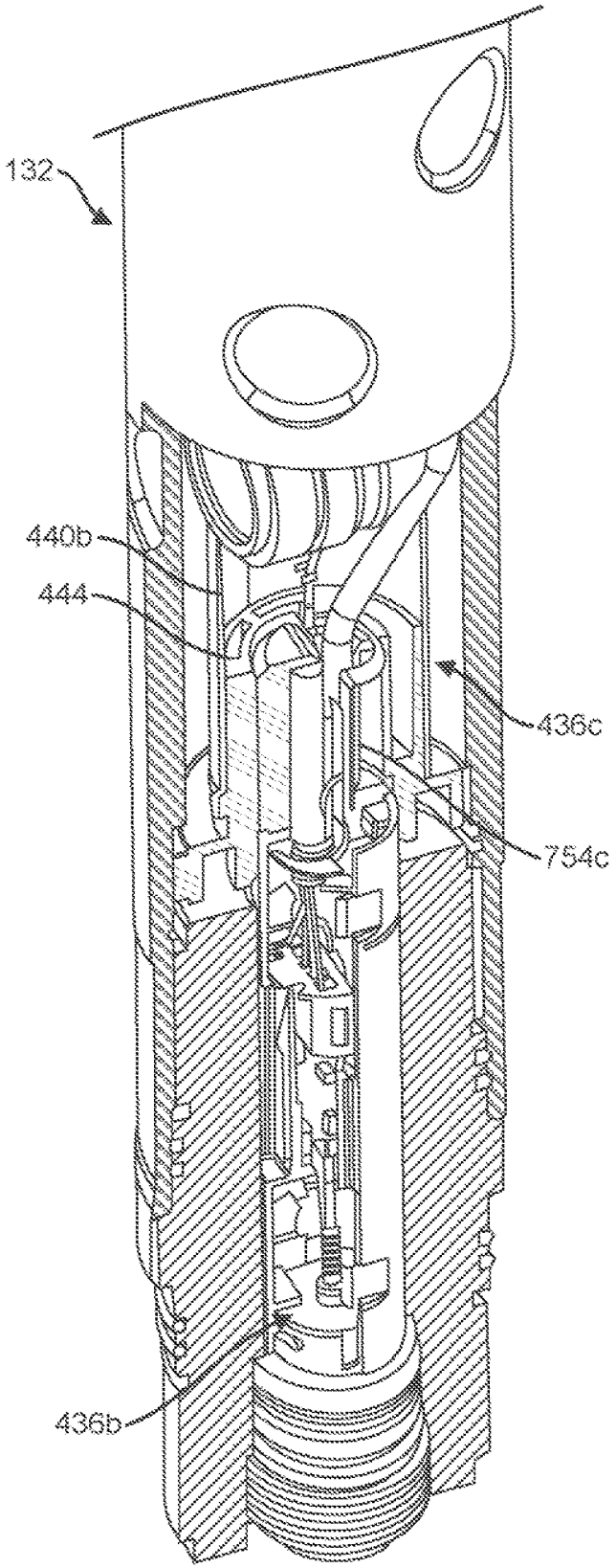
FIG. 9 is another partial cross-sectional view of a portion of the perforating unit and the detonator assembly therein.

As also shown in FIGS. 4B and 6A and in FIGS. 8A-9, the receiver 440*b* is shaped to matingly receive the detonator assembly 436*b*. FIGS. 8A-8C are partial cross-sectional views of the perforating unit 132 depicting a detonation assembly 133 therein. FIG. 9 is another partial cross-sectional view of a portion of the perforating unit 132 and the detonator assembly 133 therein.

As shown in these views, the detonator assembly 436*b* is insertable into the support sub 438*b* and into the end of the charge assembly 436*c*. The receptacle 444 of the receiver may be an offset (e.g., hemispherical) insert placed along an inner surface of the receiver 440*b* with features corresponding with the end of the detonator assembly 436*b*. The receptacle 444 may have, for example, a shape, surfaces, contacts, etc., for receivingly engaging the detonator assembly 436 to provide a secure fit for contact and communication therebetween as is described further herein.

Figure 10:
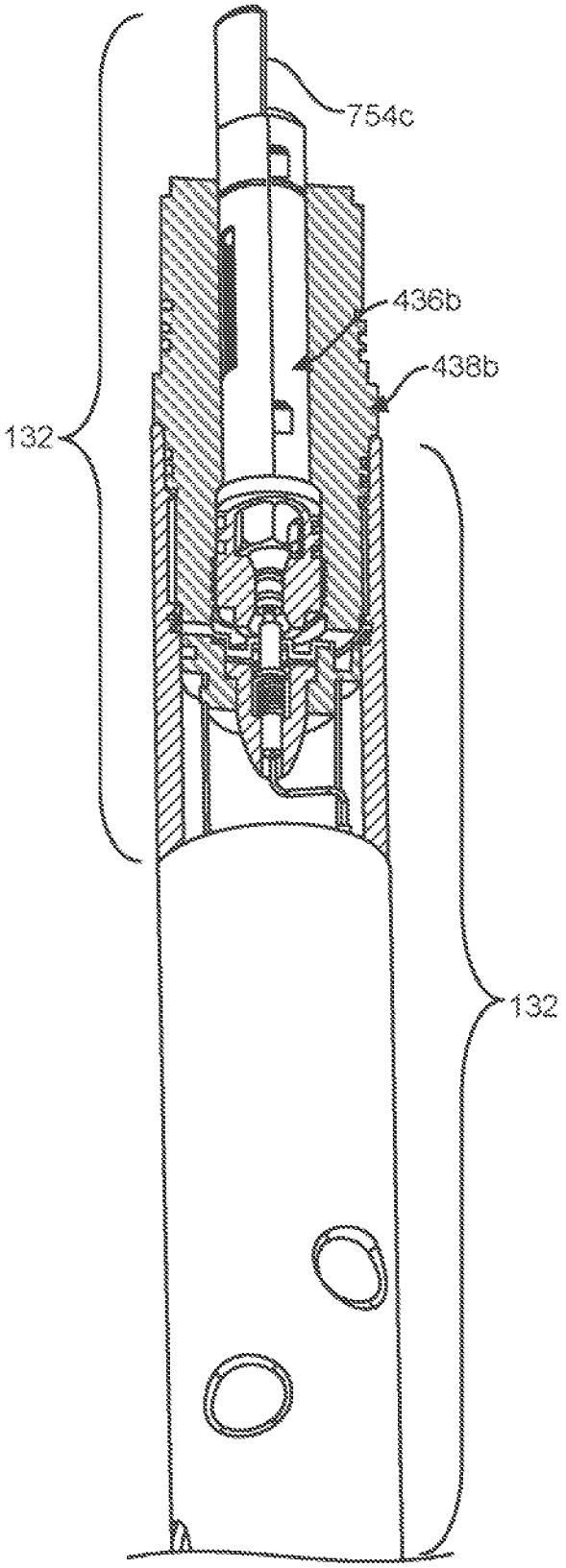
FIG. 10 is a partial cross-sectional view of a portion of the perforating unit connected to an adjacent perforating unit.
Figure 11A:
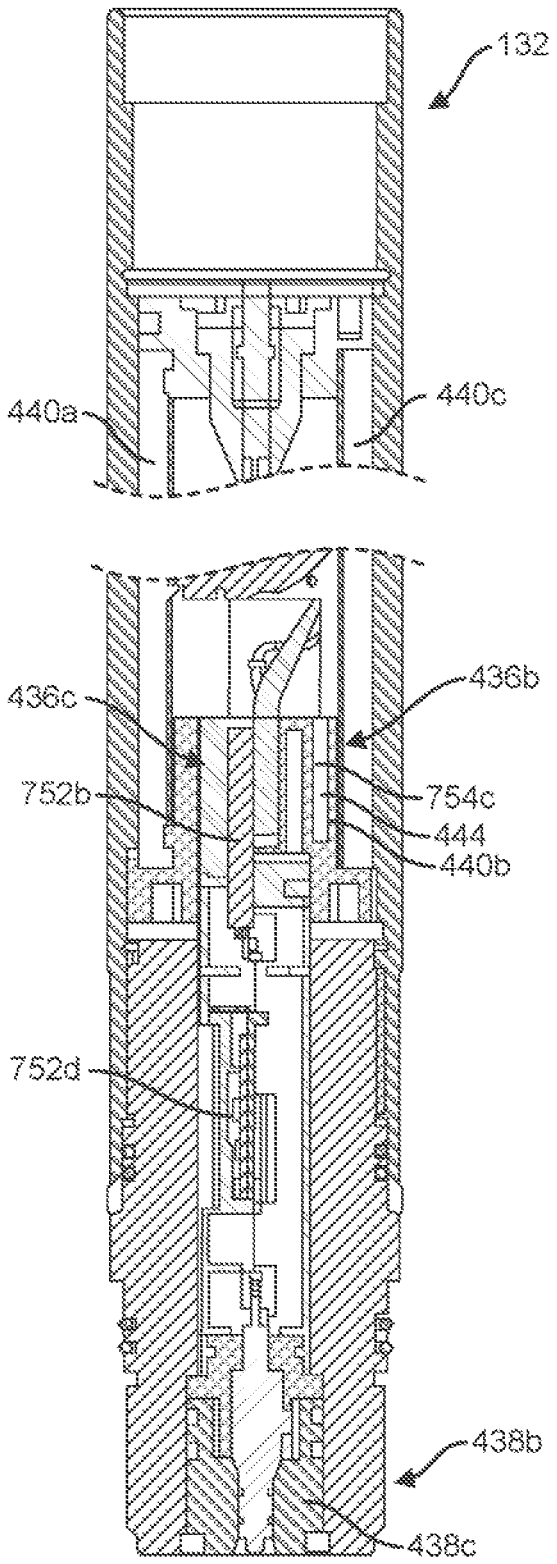
FIGS. 11A and 11B are longitudinal cross-sectional views of the detonator assembly in a seated and an unseated position, respectively, in the perforating unit.
Figure 11B:
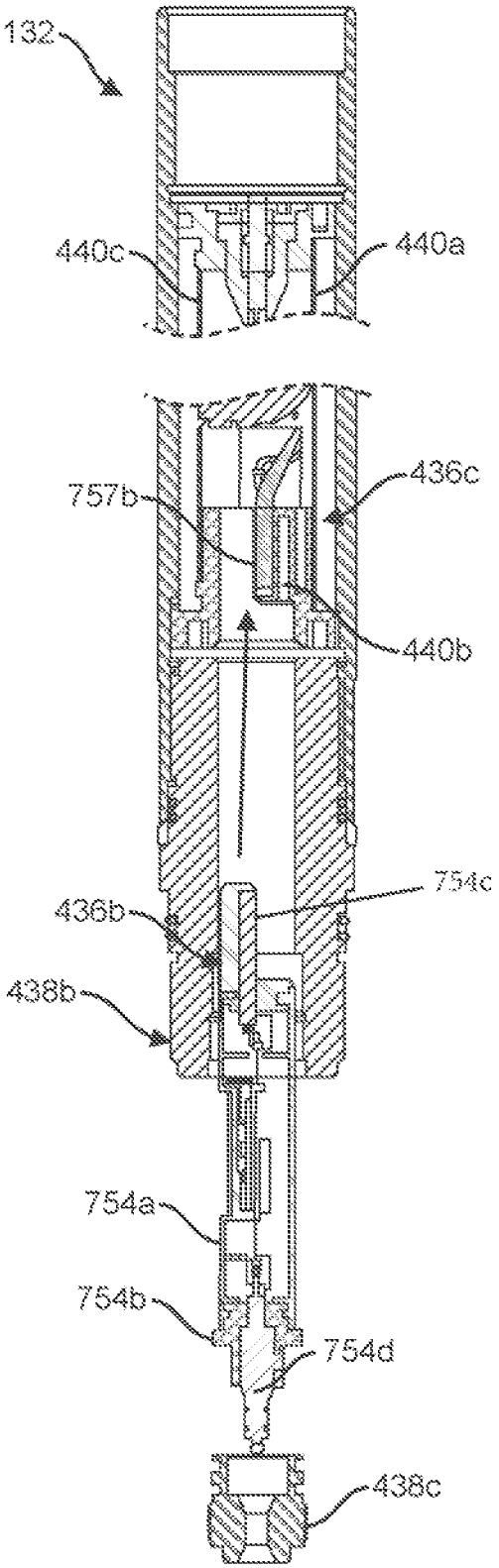
Figure 12:
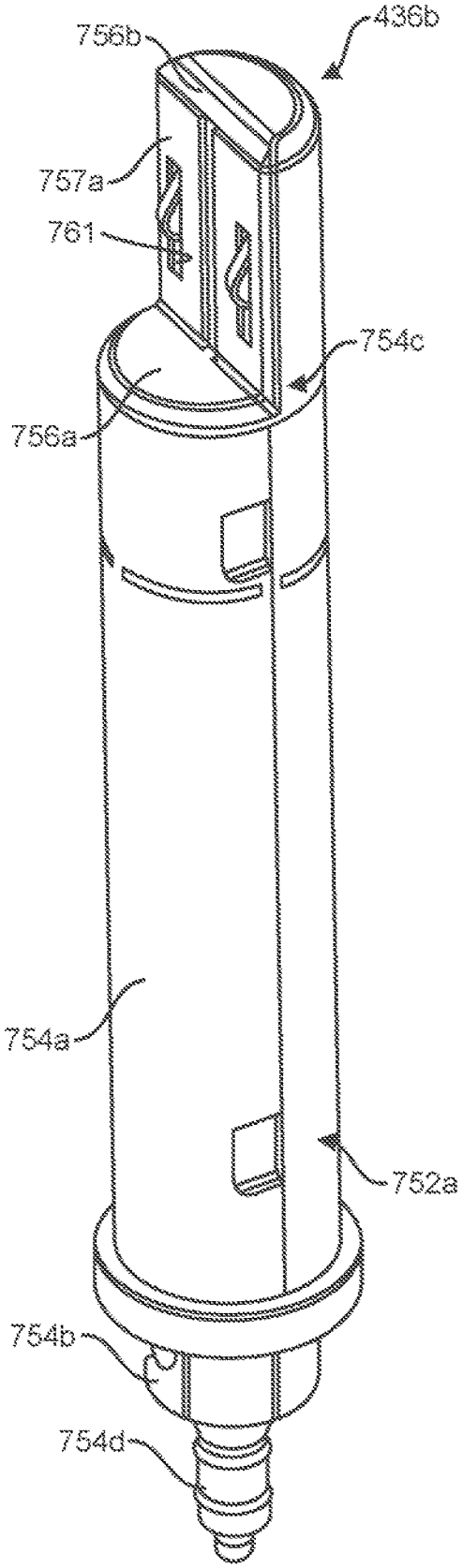
FIG. 12 is a perspective view of the detonator assembly.
Figure 13A:
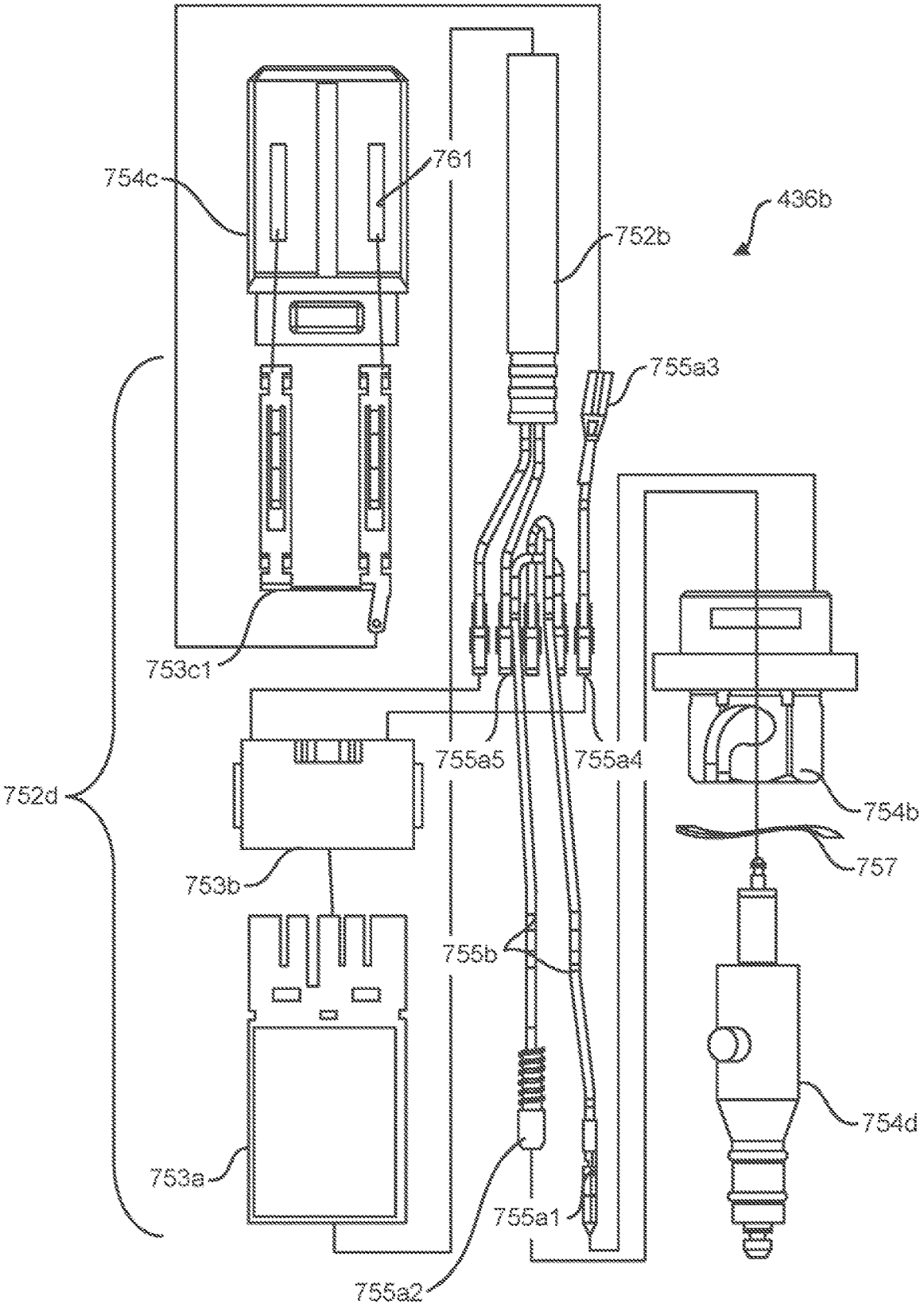
FIGS. 13A-13B are exploded views of the detonator assembly.
Figure 13B:
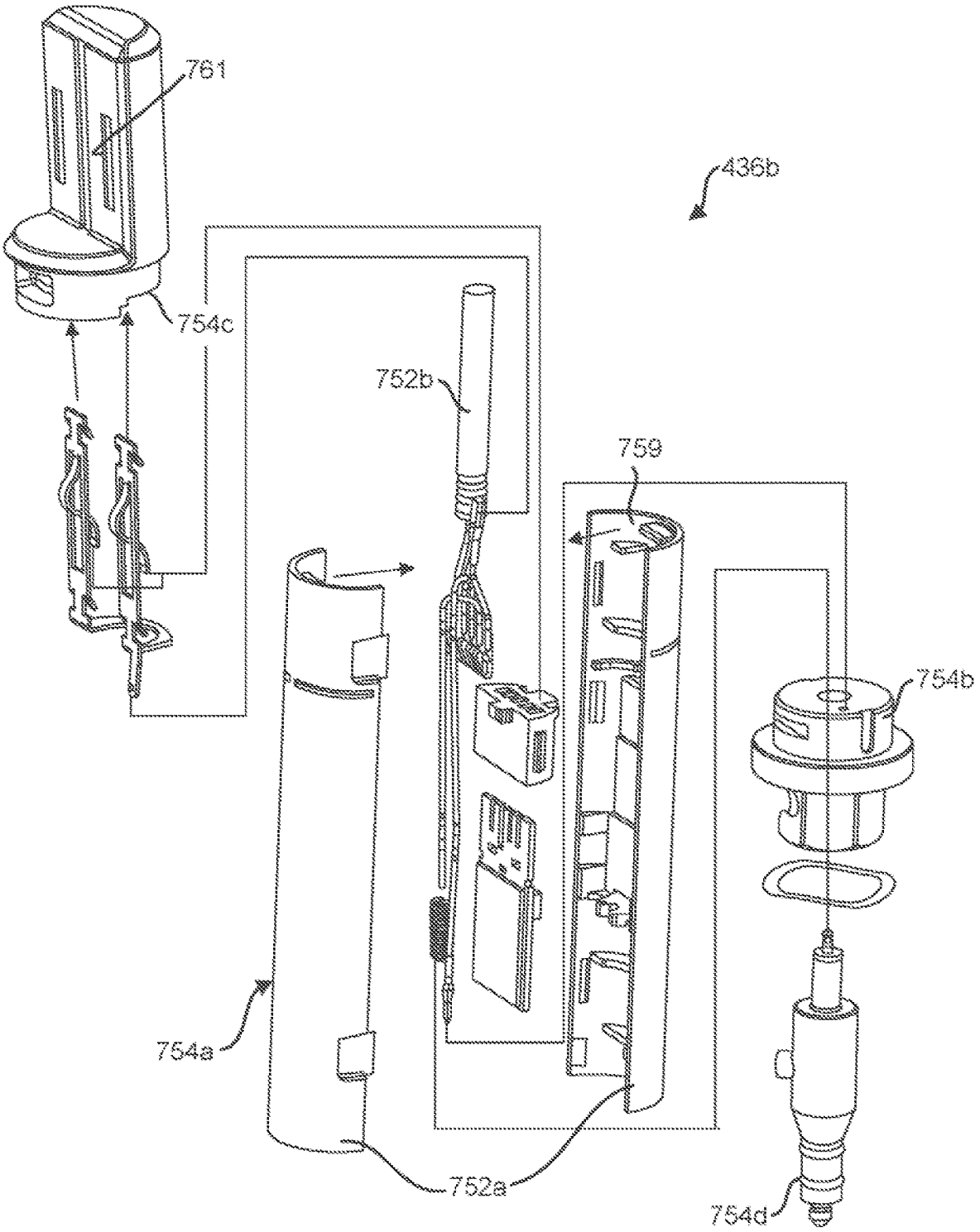

FIGS. 10 and 11A-13B show various views of the perforating unit 132 and the detonator assembly 436*b*. FIG. 10 is a partial cross-sectional view of the perforating unit 132 and the detonator assembly 436*b* therein. FIGS. 11A and 11B show cross-sectional views of the detonator assembly 436*b* in a seated and an unseated position, respectively. FIGS. 12, 13A, and 13B show the detonator assembly 436*b* outside of the perforating unit 132.

As shown in these views, the detonator assembly 436*b* includes a detonator housing 752*a*, a detonator 752*b*, and a switch assembly (or trigger) 752*d*. The detonator assembly 436*b* also includes a tube portions 754*a*, a bulkhead 754*b*, a second connector 754*c*, and a detonator feedthru 754*d*. The detonator housing 752*a* is slidably positionable in the support sub 438*b*. The detonator housing 752*a* may include one or more tube portions 754*a* connectable to form an enclosed chamber 759. The bulkhead 754*b* and the second connector 754*c* are positioned at opposite ends of the detonator housing 752*a* to close each end thereof.

The bulkhead 754*b* is positionable between the detonator housing 752*a* and the retainer 438*c*. A portion of the bulkhead 754*b* is insertable into and threadedly connected to an end of the detonator housing 752*a*. Another portion of the bulkhead 754*b* extends from the detonator housing 752*a* and is insertable into and threadedly connectable to the retainer 438*c*. The bulkhead 754*b* has a passage to receive the detonator feedthru 754*d* therethrough. The bulkhead 754*b* supports the detonator feedthru 754*d* about the end of the detonator assembly 436*b* to form a first connector for connection to the charge assembly 436*c* of an adjacent perforating unit 132.

The detonator feedthru 754*d* is connected by the switch assembly 752*d* to the detonator 752*b*. The switch assembly 752*d* includes a switch 753*a*, a plug 753*b*, and contact 753*c*1. The switch assembly 752*d* also includes connectors 755*a*1-*a*5 and cables 755*b*. The plug 753*b* is seated in the switch 753*a*. The connectors 755*a*1-*a*4 are connected to the switch plug 753*b* via cables 755*b*. The connectors 755*a*1-*a*3 are also connected to the detonator feedthru 754*d*, bulkhead 754*b*, contact 753*c*1, respectively. The connector 755*a*4 is also connected the switch plug 753*b* to the detonator 752*b*. The connectors 755*a*1-*a*4 may take various forms. In the examples shown, the connectors 755*a*1-*a*3 include a pin contact 755*a*1, a spring coupling 755*a*2, and a slotted receptacle 755*a*3 capable of mating with the components and connectable with the cables 755*b* for communication therebetween. The cables 755*b* are provided with connectors 755*a*5 for insertion into the switch plug 753*b*.

As shown in FIGS. 8A-8C, 9A-9B, and 11A-11B, the second connector 754*c* is positioned between the detonator housing 752*a* and the charge tube 440*a*. The second connector 754*c* has a cylindrical portion 756*a* positioned in an end of the detonator housing 752*a* and an insert (e.g., hemispherical) portion 756*b* extending from an end of the detonator housing 752*a*. The insert portion 756*b* extends from the detonator housing 752*a* and is positionable into the charge tube 440*a* for communicative coupling with the receptacle 444 of the receiver 440*b*.

The cylindrical portion 756*a* is shaped to close an end of the detonator housing 752*a*. The hemispherical portion 756*b* is insertable through the support sub 438*b* and into the receiver 440*b*. The hemispherical portion 756*b* is shaped to matingly engage the contact receiver positioned in the charge tube 440*a*. The hemispherical portion 756*b* is also shaped for a one way fit into the charge tube 440*a* for positive alignment therein. The hemispherical portion 756*b* is also provided with a contact surface 757*a* positionable against a corresponding contact surface 757*b* of the receptacle 444.

Figure 14:
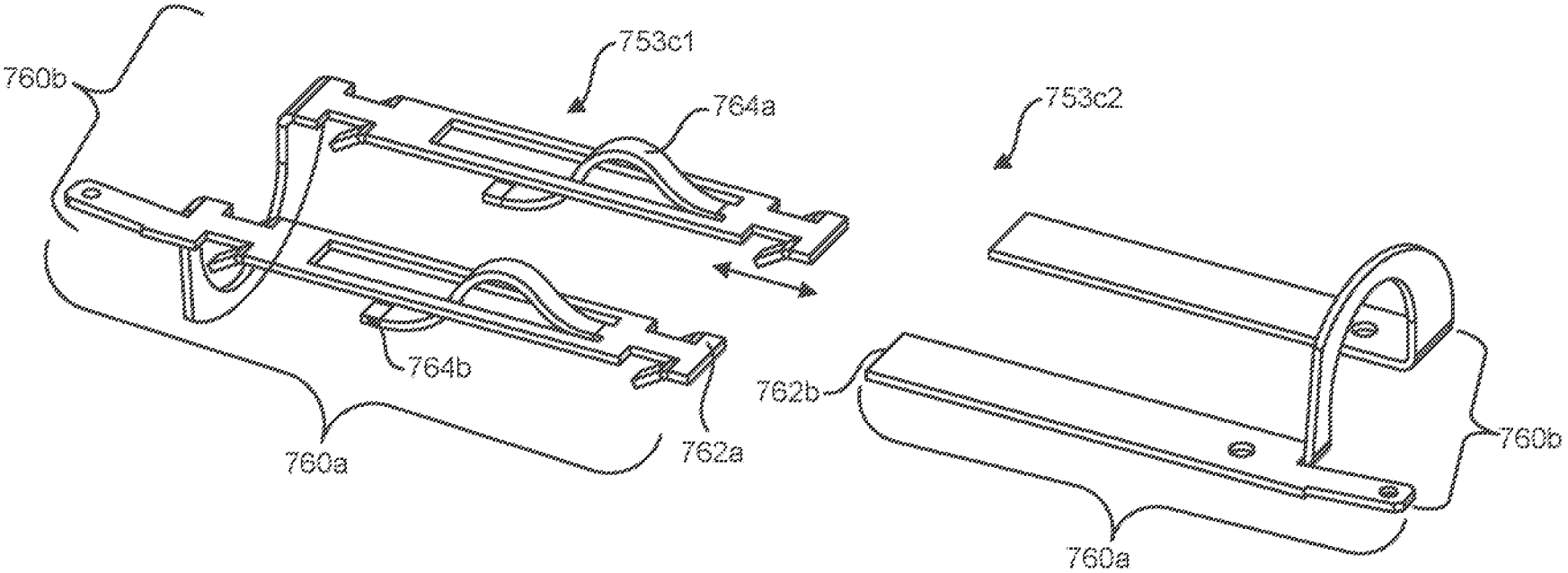
FIG. 14 is an exploded view of a detonator contact and a corresponding charge contact.

The contacts 753*c*1, *c*2 are shown in greater detail in FIG. 14. The detonation contacts 753*c*1, *c*2 may include a contact portion 760*a* and a support portion 760*b*. Both support portions 760*b* have a curved portion shaped to receivingly engage an outer surface of the detonator 752*b*, with the flat contact portions 760*a* extending from the curved support portions 760*b*. The contact portions 760*a* of each of the contacts 753*c*1, *c*2 includes a pair of arms 762*a, b* positionable parallel to each other.

Each of the arms 762*a* have elongate cutout portions that are curved about the flat portion. The cutout portions include a curved portion 764*a* and tip portions 764*b*. The curved portions 764*a* are attached at one end from the flat portion and extend therefrom to rise a distance above the flat portion. The tip portions 764*b* extend from the curved portions through an opening defined by cutout of the arms 762*a*, and to a distance below the flat portion.

The contacts 753*c*1, *c*2 may be of a conductive material (e.g., metal). The arms 762*a* may be compressible against the arms 762*b* of the adjacent support arms 762*b*. When the curved arms 762*a* are compressed against the arms 762*b*, the curved arms 762*a* have a spring force that extends therefrom. The curved arms 762*a* are shaped to extend through openings 761 in the second connector 754*c*.

The detonator contact 753*c*1 is connected at one end to the switch assembly 752*d* and has another end extended into the second connector 754*c*. The detonator 752*b* is supported in the housing between the switch assembly 752*d* and the second connector 754*c*. The detonator 752*b* is supported in the housing 752*a* by the contact 753*c*1. The curved portion 760*b* is shaped to receive an outer surface of the detonator 752*b*.

Figure 15A:
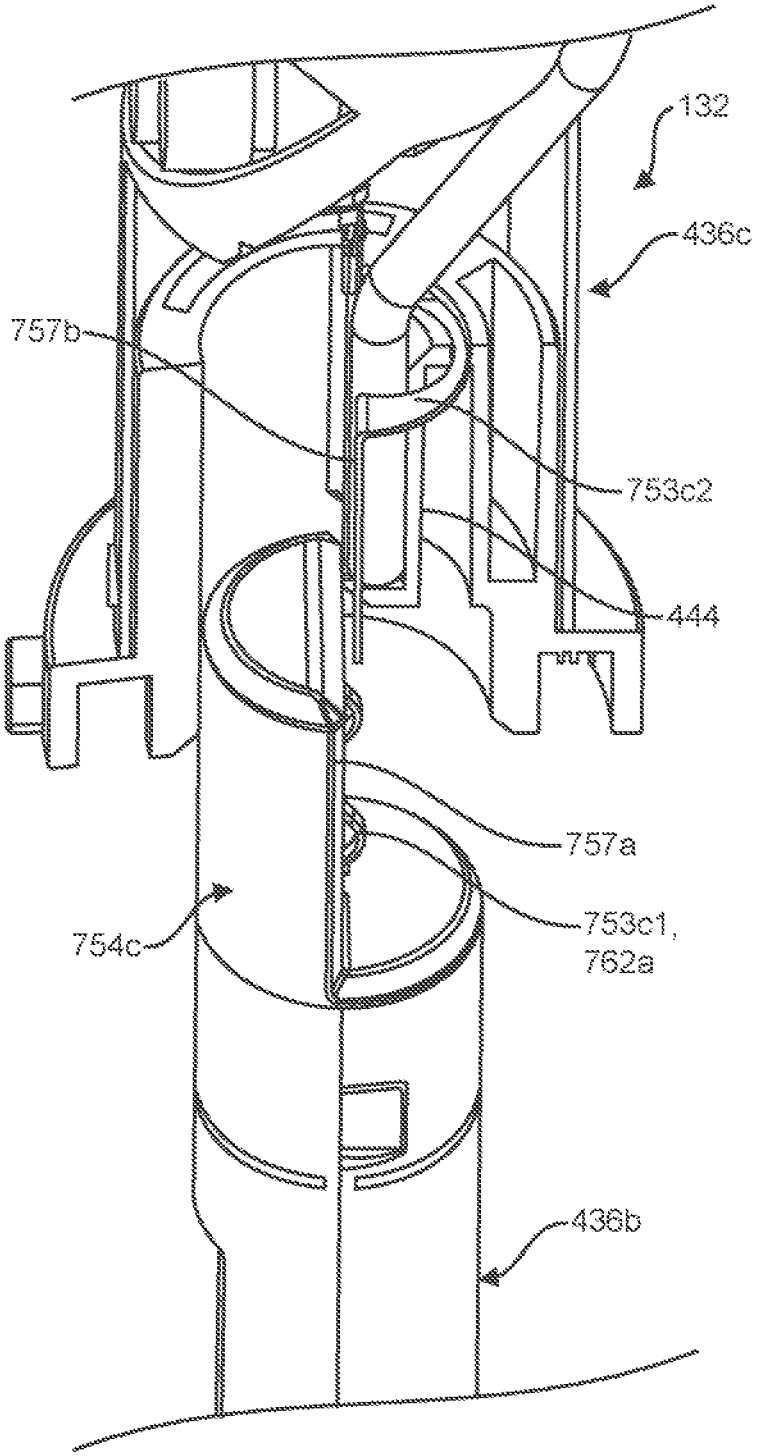
FIGS. 15A and 15B are partial cross-sectional views of the perforating unit with portions removed to show the detonator and charge contacts in a disengaged and an engaged position, respectively.
Figure 15B:
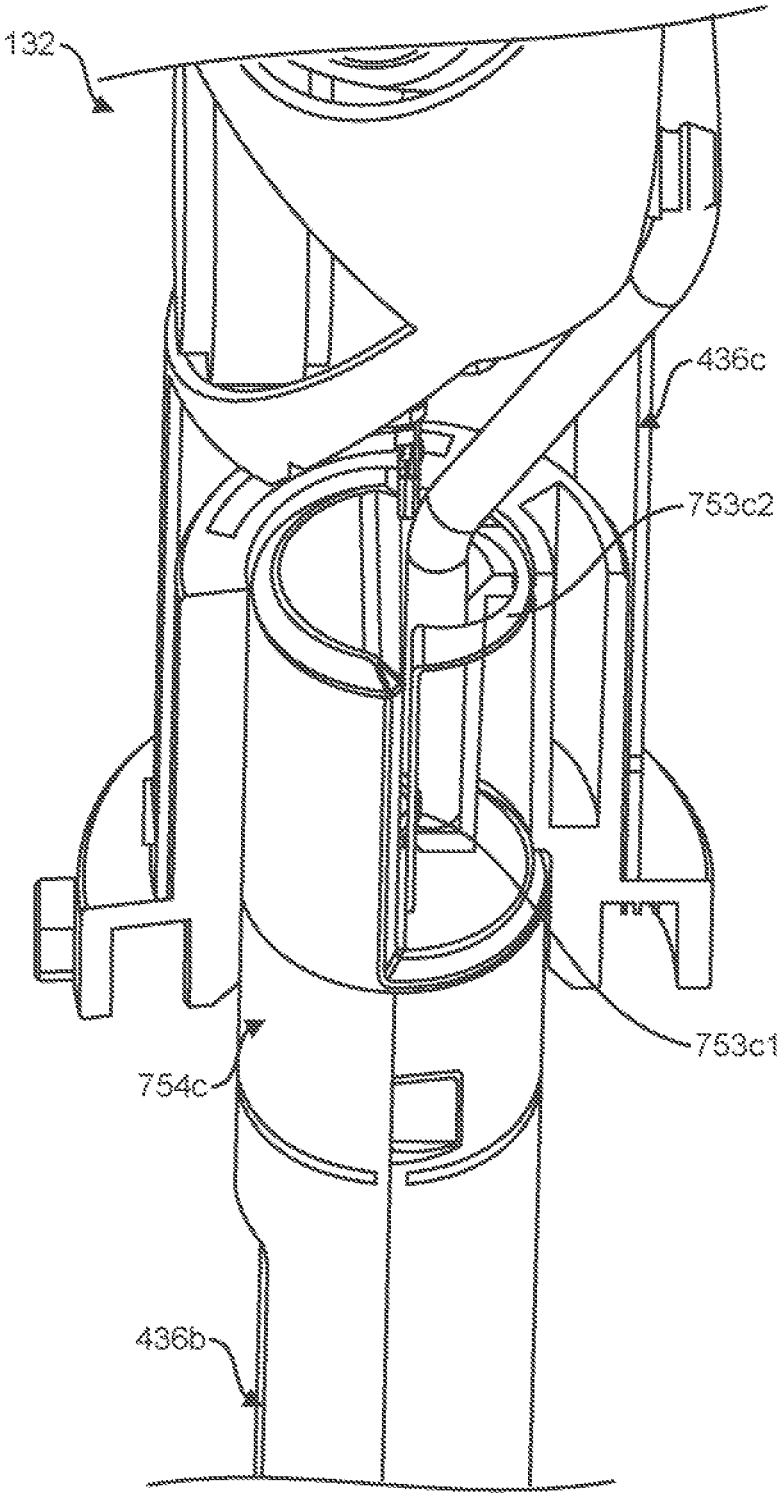

As shown in FIGS. 15A-15B (also seen in 8B-8C, 9-14B), a quick-locking connection is defined between the detonator assembly 436*b* and the charge assembly 436*c*. FIGS. 15A-15B show perforating unit 132 with the detonator assembly 436*b* before and after insertion into the charge assembly 436*c*. For descriptive purposes, portions of the perforating unit 132 have been removed so that engagement of the contacts 753*c*1, *c*2 may be seen.

When the second connector 754*c* is inserted into the receptacle 444 of the charge assembly 436*c*, the surface 757*a* of the second connector 754*c* is positioned adjacent the corresponding surface 757*b* of the receptacle 444. The curved arms 762*a* of the detonator contact 753*c*1 extends through the openings 761 for engagement with the charge receptacle 444. The spring force of the curved arms 762*a* urges the detonator contact 753*c*1 into communicative contact with the contact 753*c*2. The spring force may be defined to apply sufficient force to urge contact via the switch assembly 752*d* (FIGS. 13A-13B) to be maintained between the contacts 753*c*1 and 753*c*2.

In operation, a signal is sent from the surface unit 111 (shown in FIG. 1) via the wireline 116 and to the perforating units 132 (shown in FIG. 3). The signal passes through each of the perforation units 132 and to the detonator assemblies 436*b* (shown in FIG. 4B). When an electric communication signal from the surface unit 111 is passed through the downhole tool 118 by communication link 441, the signal is passed to a desired perforating unit 132. The signal identifies the detonator assembly 436*b* for a particular perforating unit 132. Once identified, the switch 753*a* opens enabling power to pass to the detonator 752*b* for that perforating unit 132.

The signal passes through the detonator feedthru 754*d* and the bulkhead 754*b*, and to the switch assembly 752*d* (shown in FIG. 13B). This signal opens the electric switch 753*a*, allowing electrical communication between a surface power supply and the detonator 752*b*. When the power at the surface applies voltage to the detonator 752*b*, the current is drawn and the detonator 752*b* causes the shaped charge to explode. The increased power supply voltage results in a current down the communication link 441. This current initiates a propellant within the shaped charge 136, which creates an expanding gas inside. This explosion activates the charge cable 442*a* which causes the shaped charges 136 in the charge tube (shown in FIG. 4B) to explode and creating the perforations 135 (shown in FIG. 1).

Integrated Detonation Assembly

FIGS. 16-22 depict aspects of the perforating units 1632 (with integrated detonator assemblies 1633) usable with the downhole tool 118 of FIGS. 1 and 2. As demonstrated in FIGS. 16-22, the perforating units 1632 may be configured with features to facilitate transport to, and assembly at, any location (e.g., an assembly facility, field locations, and/or a wellsite 100 of FIG. 1). Optionally, parts for the perforating units 1632 may be disposable, thereby eliminating the need to recover parts (and prepare them for reuse) and thereby providing fully disposable components after perforating.

The perforating units 1632 of FIGS. 16-23 may incorporate or be used in combination with features of the perforating units 132 of FIGS. 1-15. The perforating unit 1632 may have similar capabilities as the perforating units 132, and may also have additional capabilities including, but not limited to: transportability assembly at any location, reliable and faster connection, flexible configuration, ability to combine one or more integrated detonator assemblies and/or quick connected detonator assemblies within the downhole tool, automated electrical connection, electrical connection between multiple connected assemblies, disposable parts (i.e., no requirement to reuse parts), multiple contact electrical connectors, orientable connection and/or positioning (e.g., azimuthal orientation), mated connections, locked connections, among other.

Figure 16:
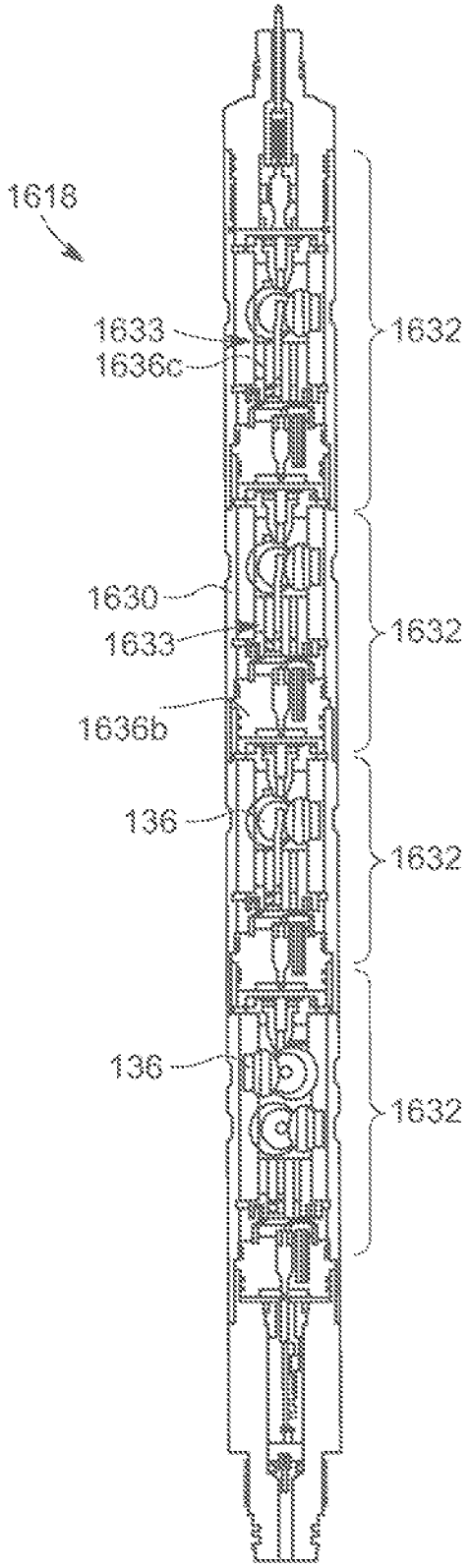
FIG. 16 is a longitudinal, cross-sectional view of a portion of a downhole perforating tool comprising perforating units, each perforating unit comprising an integrated detonation assembly, on one particular embodiment.

FIG. 16 is a longitudinal, cross-sectional view of a portion of the downhole perforating tool 1618 comprising the perforating units 1632. Each of the perforating units 1632 comprise an integrated detonation assembly 1633. The perforating units 1632 are connected end to end in series. Each of the integrated detonation assemblies 1633 includes the detonator assembly 1636*b* and a charge assembly 1636*c* slidably insertable into an outer housing 1630. The integrated detonation assembly 1633 is configured for automatic connection (e.g., mechanical and electrical connection) during assembly as is described further herein.

Figure 17A:
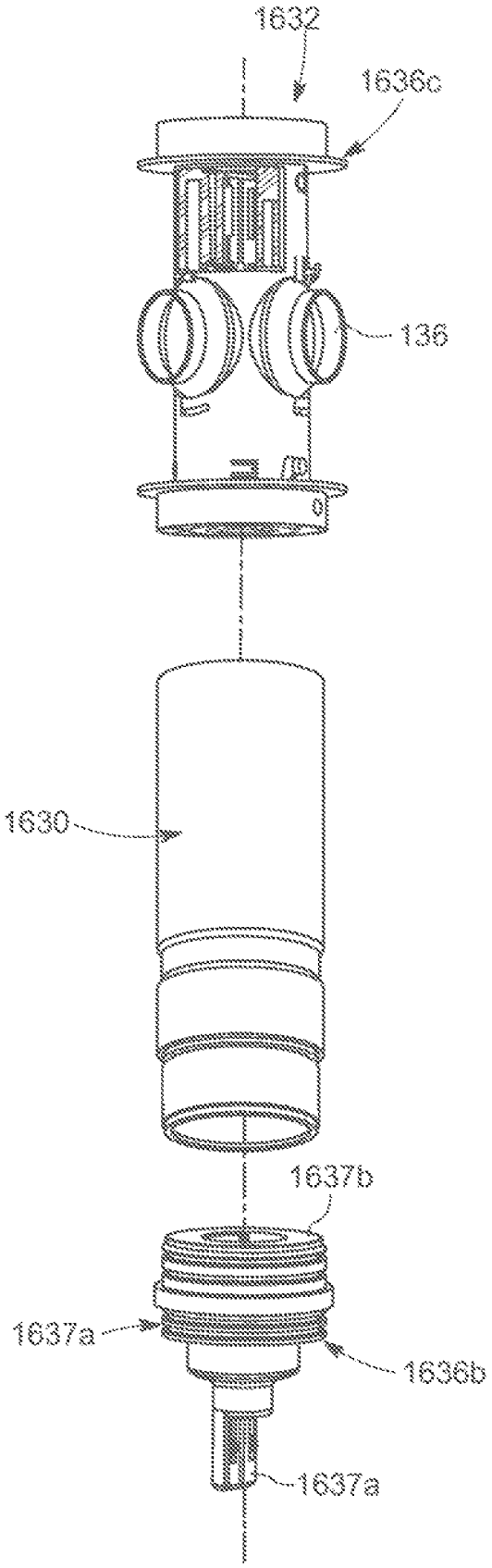
FIGS. 17A and 17B are exploded and perspective views of the perforating unit of FIG. 16.
Figure 17B:
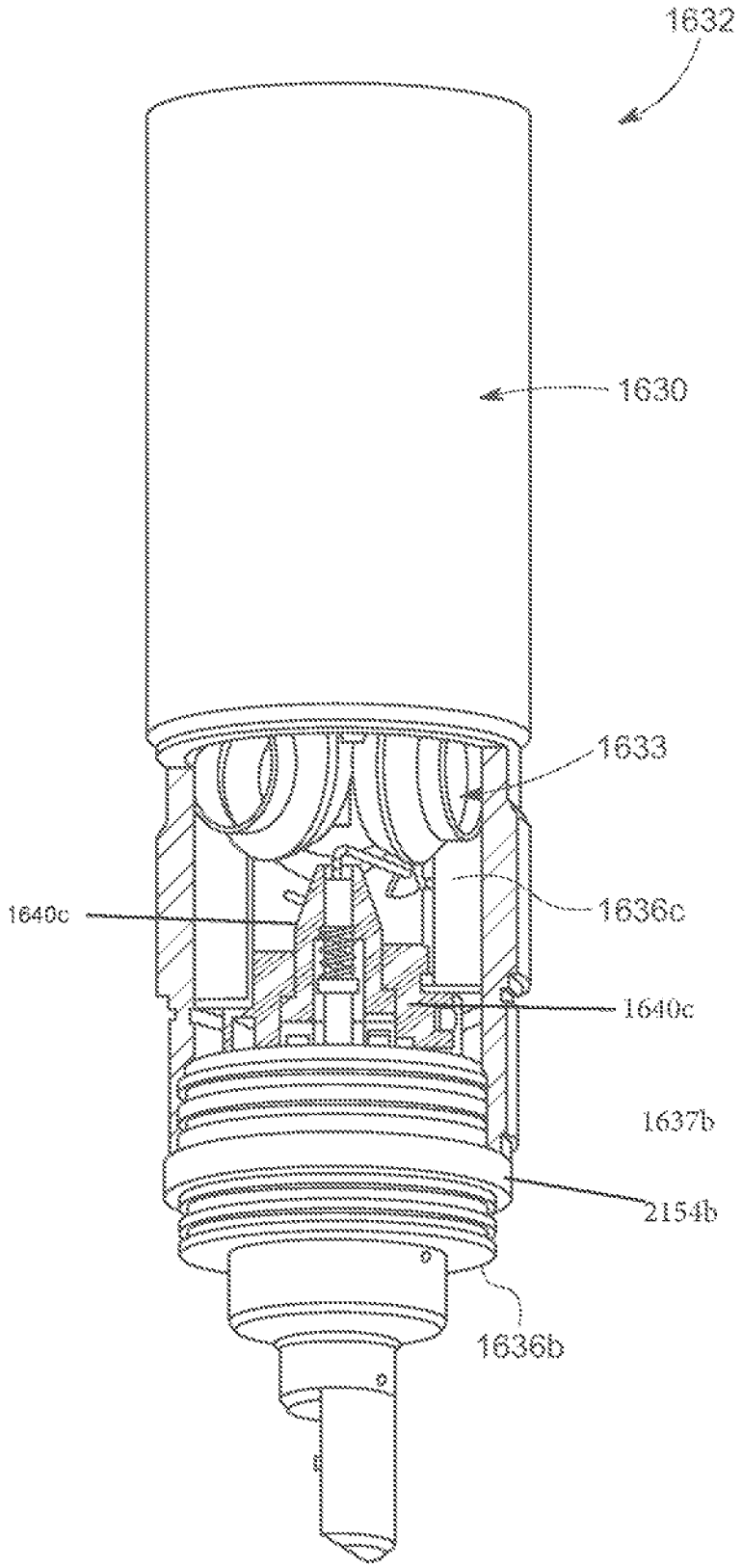
Figure 18A:
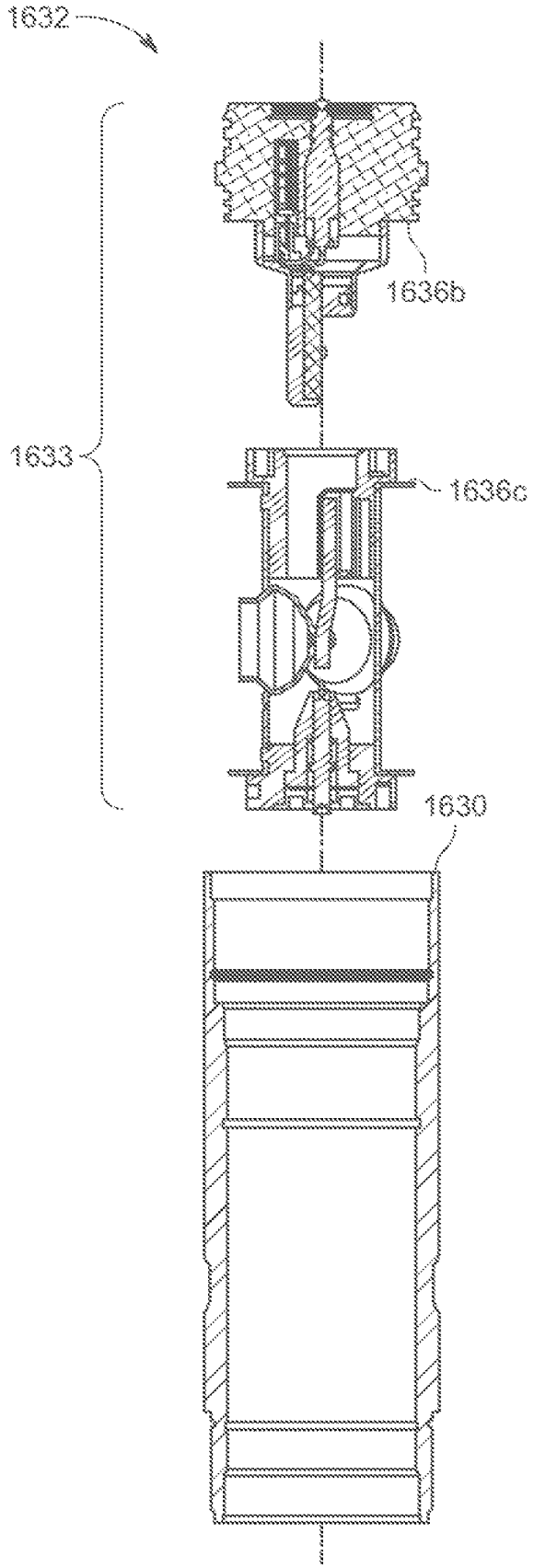
FIGS. 18A-18C are exploded, partially assembled, and longitudinal, cross-sectional views, respectively, of the perforating unit of FIG. 16.
Figure 18B:
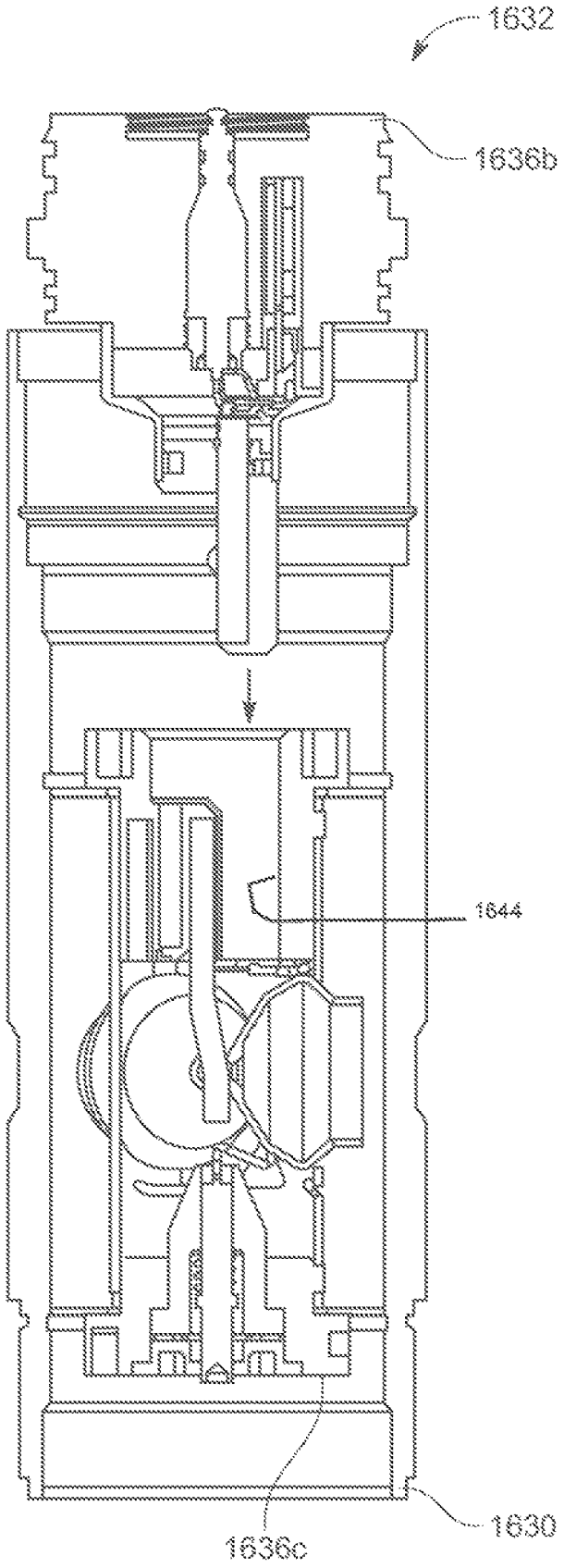
Figure 18C:
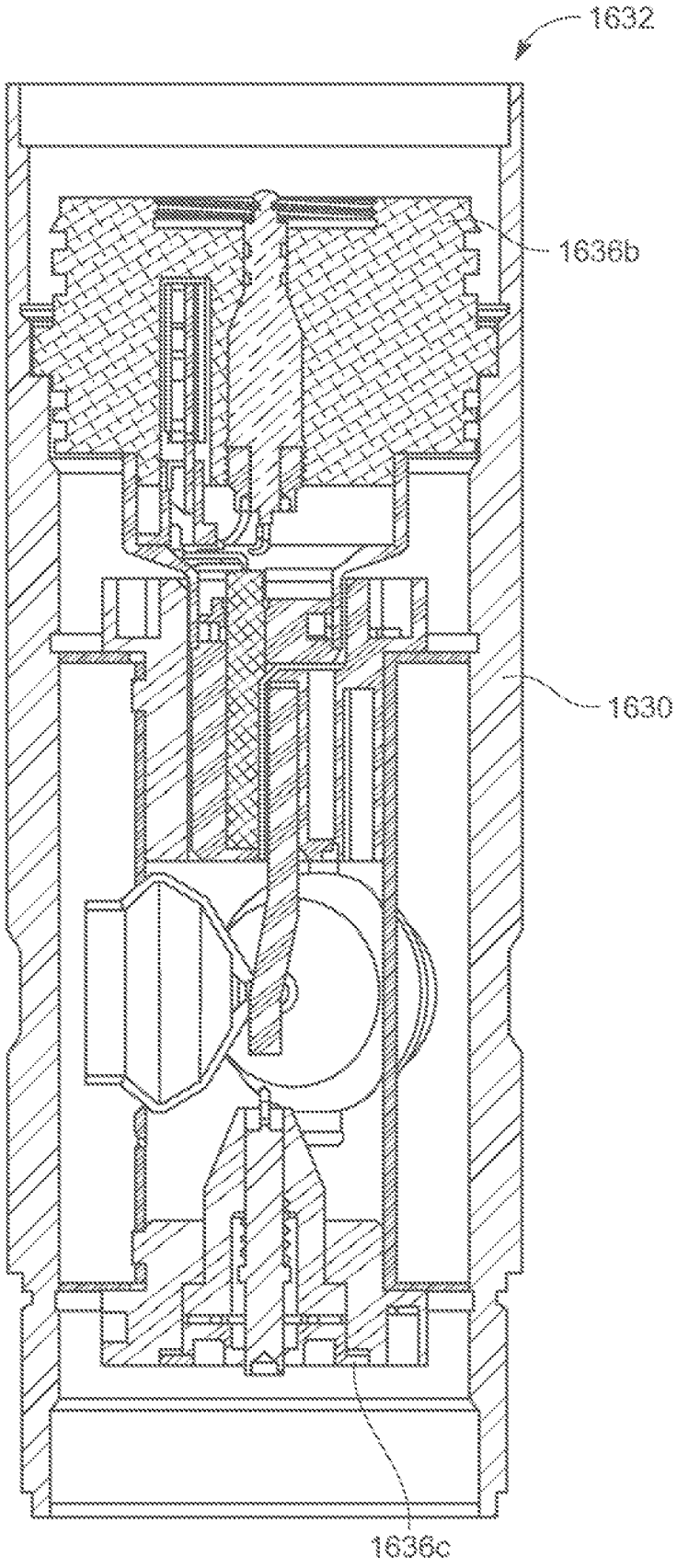
Figure 19A:
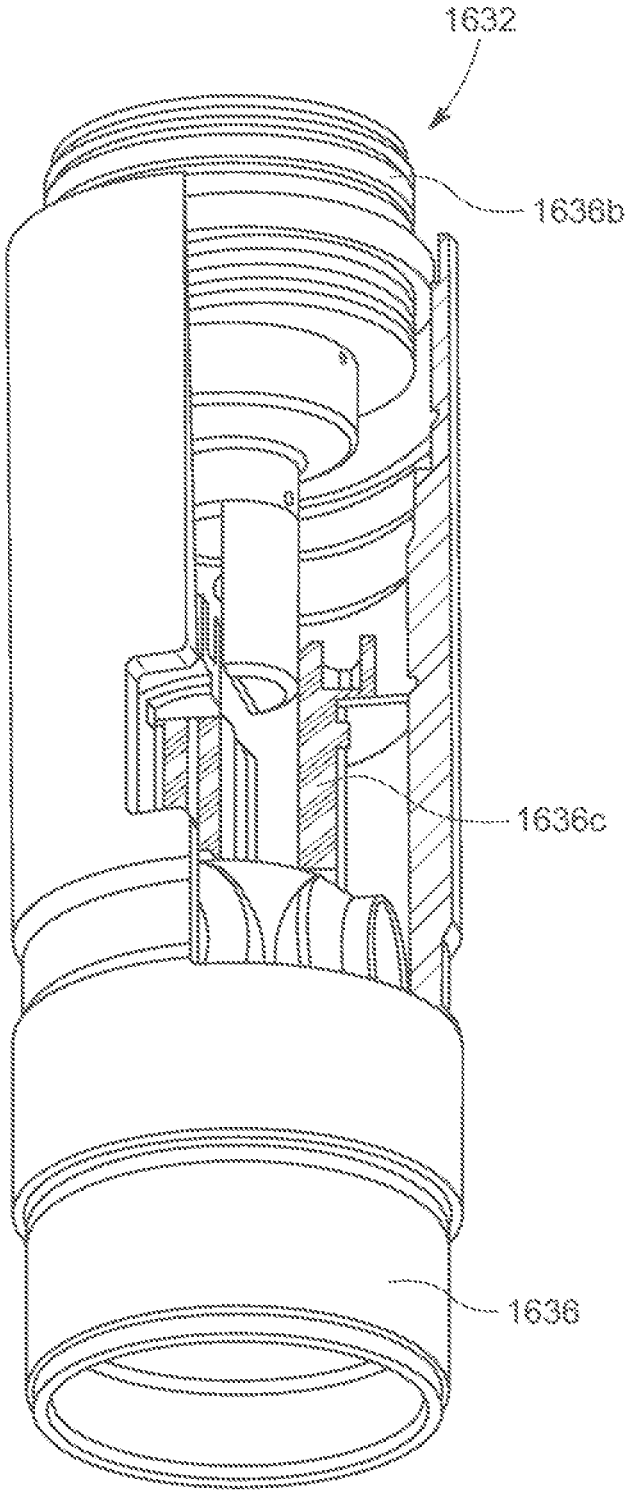
FIGS. 19A-19C are various partial, cross-sectional views of the perforating unit of FIG. 16.
Figure 19B:
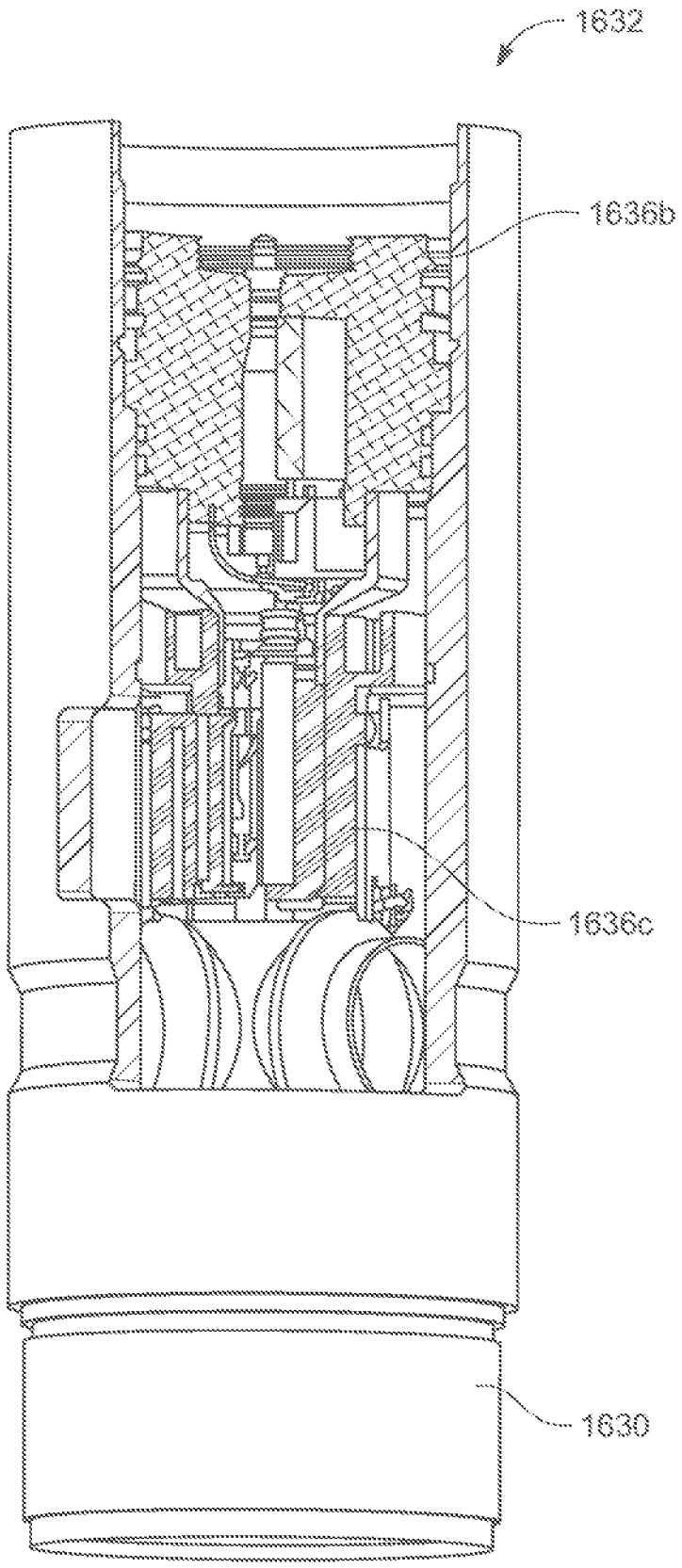
Figure 19C:
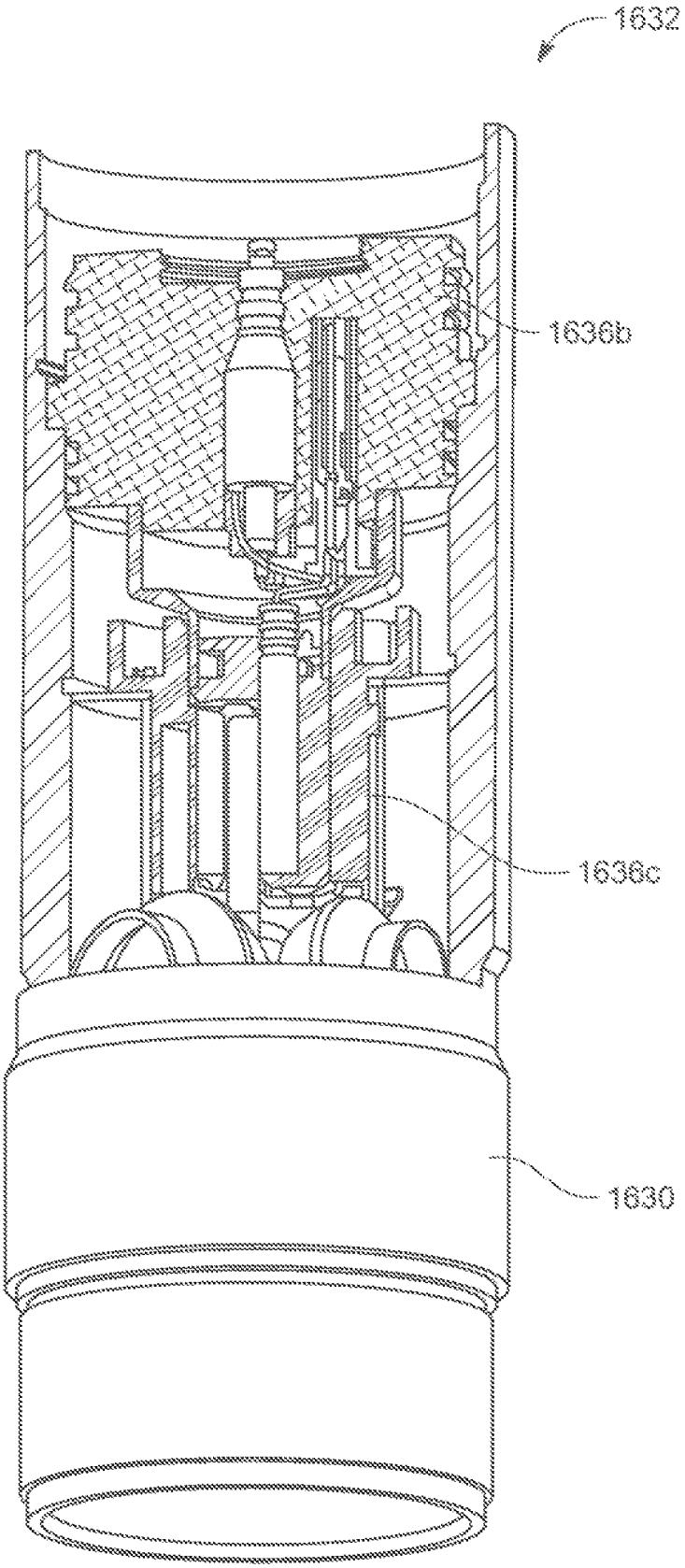

FIGS. 17A-19C show features of one particular embodiment of the perforating units 1632 in greater detail. FIGS. 17A and 17B are exploded and perspective views of the perforating unit 1632 (partially in cross-section). FIGS. 18A-18C are exploded, partially assembled (partially in cross-section), and longitudinal, cross-sectional views, respectively, of the perforating unit 1632. FIGS. 19A-19C are various partial, cross-sectional views of the perforating unit 1632. This version of the perforating unit 1632 is similar to the perforating unit 132 of FIGS. 3-15, except this version has the integrated detonation assembly 1633. The integrated detonation assembly has mated interlocking components secured within the outer housing 1633 in a one-way azimuthal orientation for simplified assembly and reliable connection.

Referring collectively to FIGS. 17A-19C, the perforating unit 1632 may be assembled by inserting the detonator assembly 1636*b* and the charge assembly 1636*c* into the outer housing 1630. During this insertion, the detonator assembly 1636*b* and the charge assembly 1636*c* are positionable for one-way mated connection therebetween to form the integrated detonation assembly 1633. By this connection, the detonator assembly 1636*b* and the charge assembly 1636*c* are orientable within the outer housing 1630 and to each other for communicative connection therebetween.

The outer housing 1630 is a tubular member shaped to receive the integrated detonation assembly 1633 therein. The outer housing 1630 may be provided with connection means (e.g., internal threads) for connection of the outer housing 1630, and to a portion of an adjacent perforation unit 1632. While not shown in this version, additional housings may optionally be provided, such as the outer housing 130 and the outer tube 438*a* of FIGS. 2 and 5. Also, while not shown in FIGS. 16-22, the outer housing 1630 may be provided with openings 443, such as those of FIG. 4A for passing the shaped charges 136 therethrough.

Figure 20A:
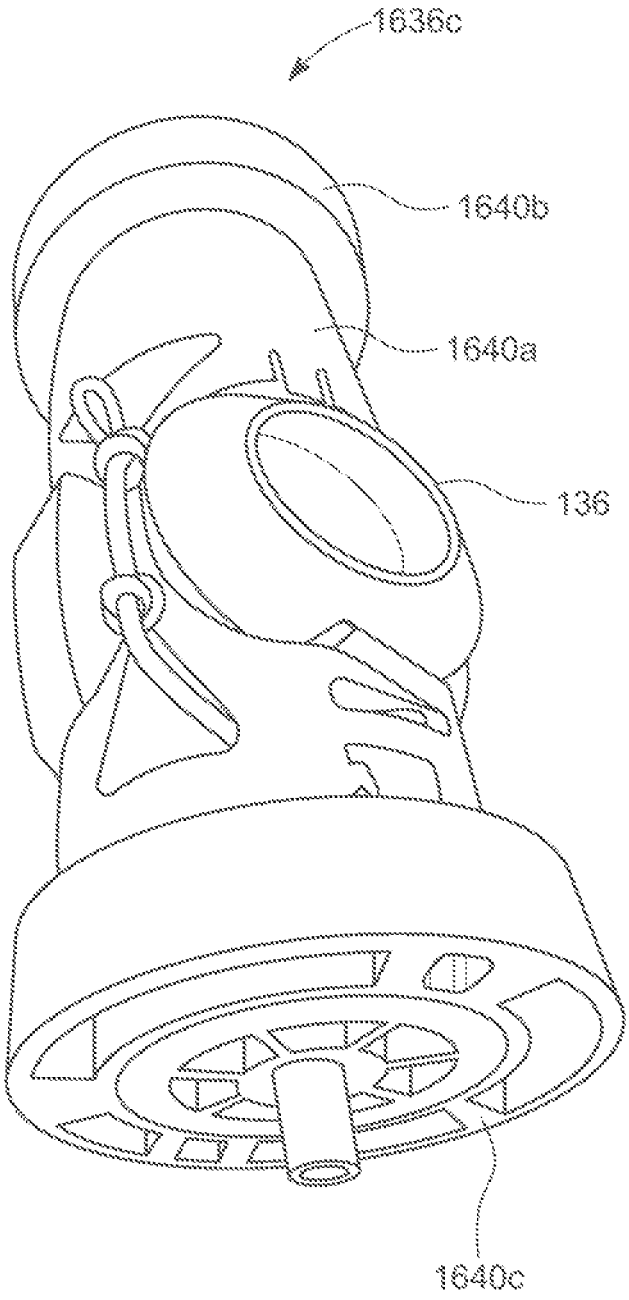
FIGS. 20A-20C are perspective, longitudinal cross-sectional, and exploded views, respectively, of a charge assembly of the perforating unit of FIG. 16.
Figure 20B:
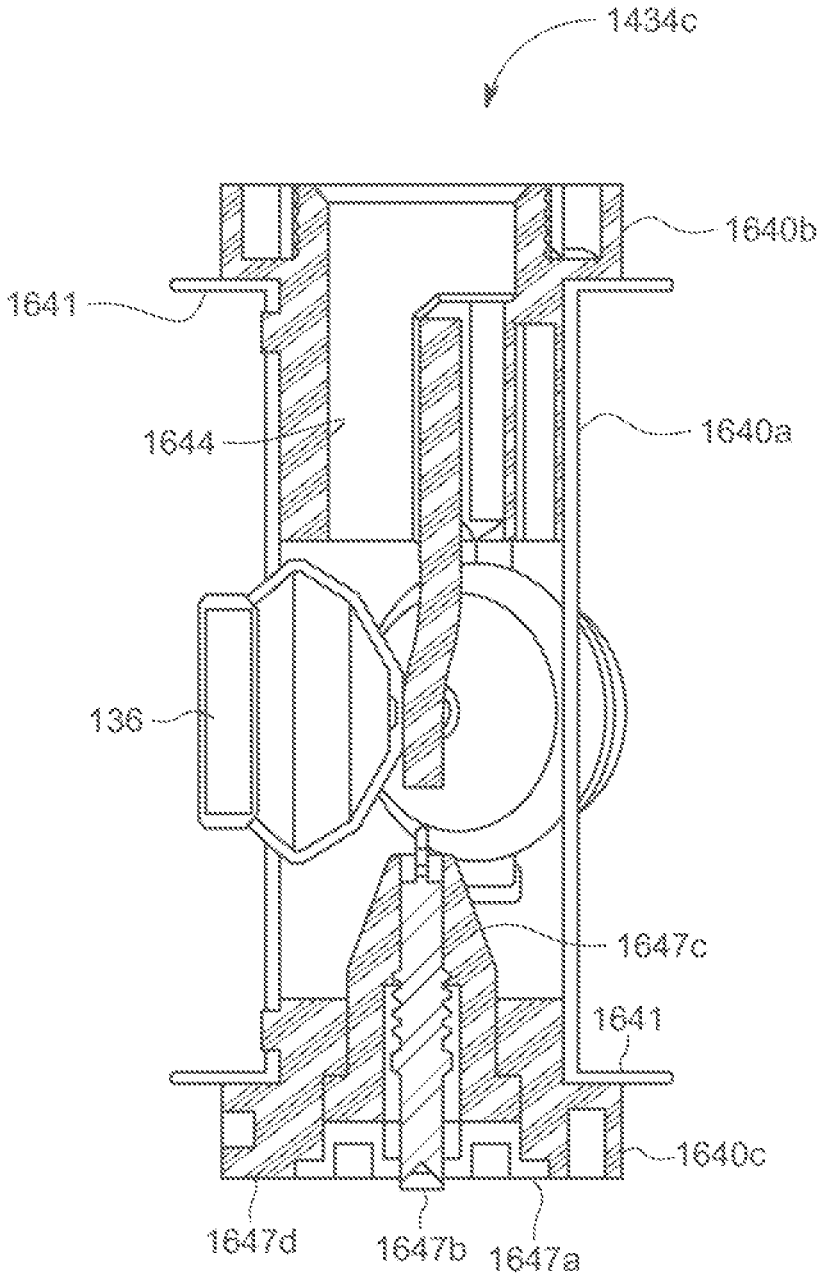
Figure 20C:
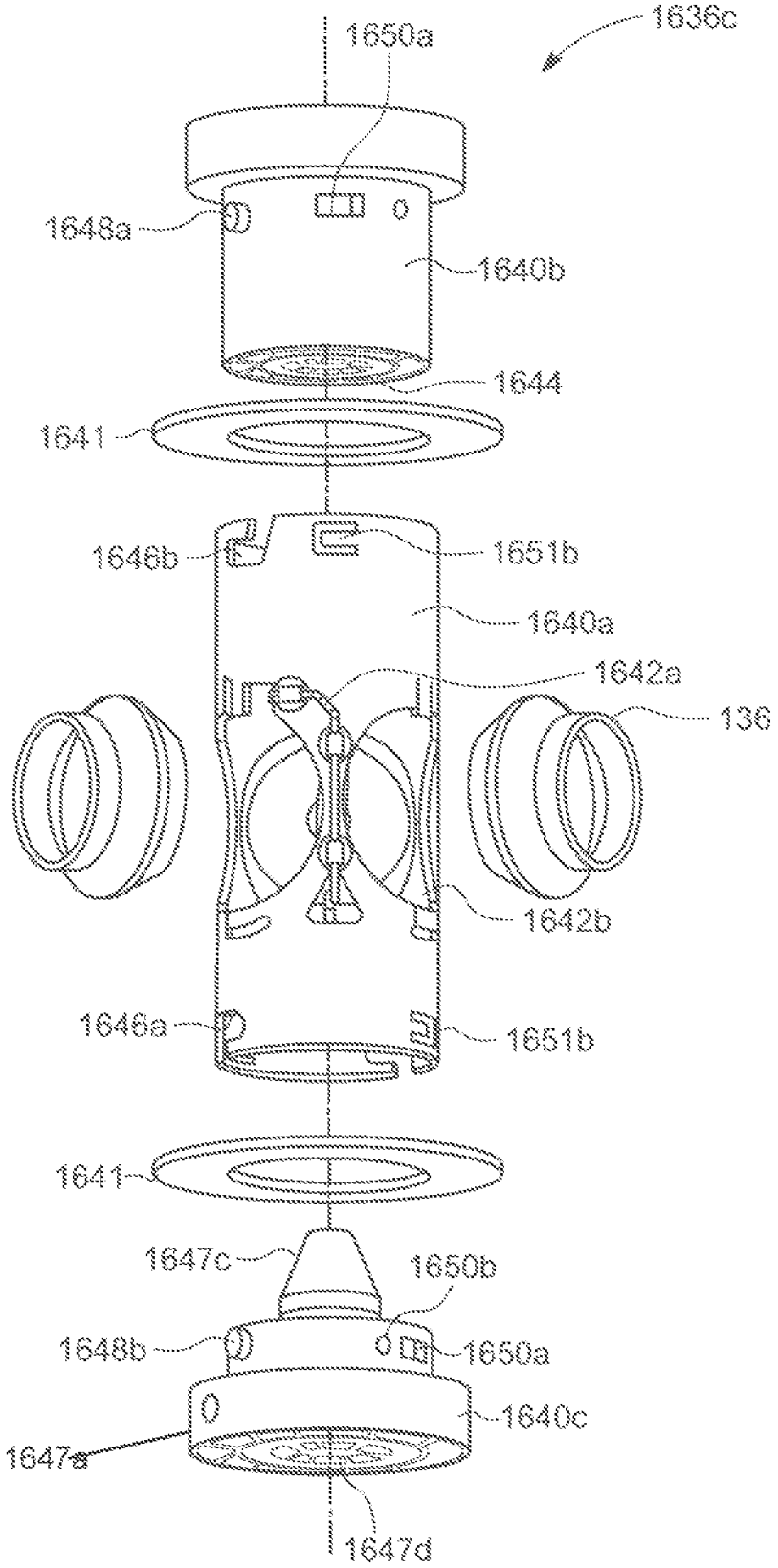

The charge assembly 1636*c* is shown in greater detail in FIGS. 20A-20C. FIGS. 20A-20C are perspective, longitudinal cross-sectional, and exploded views, respectively, of a charge assembly 1636*c* of the perforating unit 1632. The charge assembly 1636*c* may be similar to the charge assembly 436*c* of FIGS. 6A-7. The charge assembly 1636*c* includes a charge tube 1640*a*, a receiver 1640*b*, a charge feedthru 1640*c*, and rings 1641.

The charge tube 1640*a* may be similar to the charge tube 440*a* of FIGS. 6A-6B. In this version, the charge tube 1640*a* is shown as a shorter tube with only three ports 1642*b* therethrough, and with three shaped charges 136 positioned thereabout. However, it will be appreciated that the size and number of ports 1642*b* may vary. The ports 1642*b* extend through the charge tube 1640*a*. The shaped charges 136 are positioned about the ports 1642*b* to fire jets therethrough upon detonation. The shaped charges 136 may be supported about the ports 1642 and held in place by bending a tab (not shown). The ports 1642*b* may be alignable with openings in the outer housing 1630 for firing therethrough upon detonation (see, e.g., openings 443 of FIG. 4A).

The receiver 1640*b* and the charge feedthru 1640*c* are insertable into and connected to opposite ends of the charge tube 1640*a*. One of the rings 1641 is positioned between the charge tube 1640*a* and the receiver 1640*b*, and the other ring 1641 is positioned between the charge tube 1640*a* and the receiver 1640*b*. The rings 1641 are supported about the charge tube 1640*a* adjacent to the receiver 1640*b* and the feedthru 1640, and are shaped for sliding insertion into the outer housing 1630 as shown in FIGS. 17A-17C. The rings 1641 may act as a centralizer shaped to support the charge assembly 1636*c* within the outer housing 1630.

As shown in FIG. 20C, the charge tube 1640*a*, the receiver 1640*b*, and the feedthru 1640*c* may have quick-locking features for locking connection and orientation therebetween. In the example shown, the charge tube 1640*a* is provided with guide slots 1646*a, b* at each end shaped to matingly receive keys 1648*a, b* positioned on the receiver 1640*b* and the feedthru 1640*c*, respectively. When inserted into the end of the charge tube 1640*a*, the key 1648*a* of the receiver 1640*b* is slidingly receivable into the guide slot 1646*a*. The receiver 1640*b* may be rotated so that the key 1648*a* passes into the guide slot 1646*a*, thereby positioning the receiver 1640*b* in the desired position while also helping to prevent unintentional retraction of the receiver 1640*b* out of the charge tube 1640*a*. The charge tube 1640*a* may also be provided with locking tabs 1651*a*, fastener holes 1651*b* for receiving the locking tabs 1651*a*, fasteners, and other locking features, such as those described in FIG. 7.

The charge tube 1640*a* also has a charge cable 1642*a* for communication with the shaped charges 136. The charge cable (or detonator cord) 1642*a* may act as a fuse connected to the receiver 1640*b*. The charge cable 1642*a* extends from the receiver 1640*b* through the charge tube 1640*a* and along an outer surface of the charge tube 1640*a*. The charge cable 1642*a* is connected to each of the shaped charges 136 in the charge tube 440*a* for activation thereof. The charge tube 1640*a* is supported within the outer housing 1630 between the two rings (end caps) 1641. The charge tube 1640*a* may be manufactured with clips (not shown) to support the charge cable 1642*a* (and wire 441 of FIG. 4) therethrough. The charge cable 1642 may be pushed into the receiver 1640*b* during assembly.

The receiver 1640*b* may have features similar to those of receiver 440*b* of FIGS. 6A-6B. The receiver 1640*b* may be a flange shaped member insertable into an end of the charge tube 1640*a*. The receiver 1640*b* may be shaped to receivingly support the ring 1641 adjacent to the charge tube 1640*a*. The receiver 1640*b* may also be provided with a charge receptacle 1644 therein shaped to receive a portion of the detonator assembly 1636*b* therein for connection and communication with the charge cable 1642.

The charge feedthru 1640*c* may be similar to the charge feedthru described in FIGS. 6A-7. The charge feedthru 1640*c* includes the locking cap 1647*a*, the plunger 1647*b*, the retainer 1647*c*, and the end plate 1647*d* similar to those described in FIG. 7. Optionally, the charge feedthru 1640*c* may also include springs. The charge feedthru 1640*c* may be inserted into and supported about the charge tube 1640*a*. The charge feedthru 1640*c* may also be shaped to receive the ring 1641 for support adjacent to the charge tube 1640*a*. The charge feedthru 1640*c* is shaped for engagement with the detonator assembly 1636*b* for connection and communication therewith. The locking cap 1647*a* may be secured (e.g., bolted to) the detonator assembly 1636*b* of an adjacent integrated detonation assembly 1633 to allow for the connection of a series of integrated detonation assemblies 1633. The plunger 1647*b* is communicatively connected to the detonator assembly 1636*b* of the adjacent integrated detonation assembly 1633 for communication therebetween.

When connected in series, multiple ones of the integrated detonation assemblies 1633 may be communicatively connected to pass signals therethrough for activation of the detonation assembly 1633 to set off the shaped charges 136 as is described further herein. A communication link (e.g., wire 441 of FIG. 4) may extend through the detonation assemblies 1633 of each of the perforating units 1632 (FIG. 16) for selectively activating one or more of the detonator assemblies 1636*b* to fire their respective shaped charges 136. Each integrated detonation assembly 1633 may be provided with connections at each end that are mated to facilitate connection to an adjacent detonation assembly 1633 and to reliably assure communicative connection therebetween or therethrough.

Figure 21A:
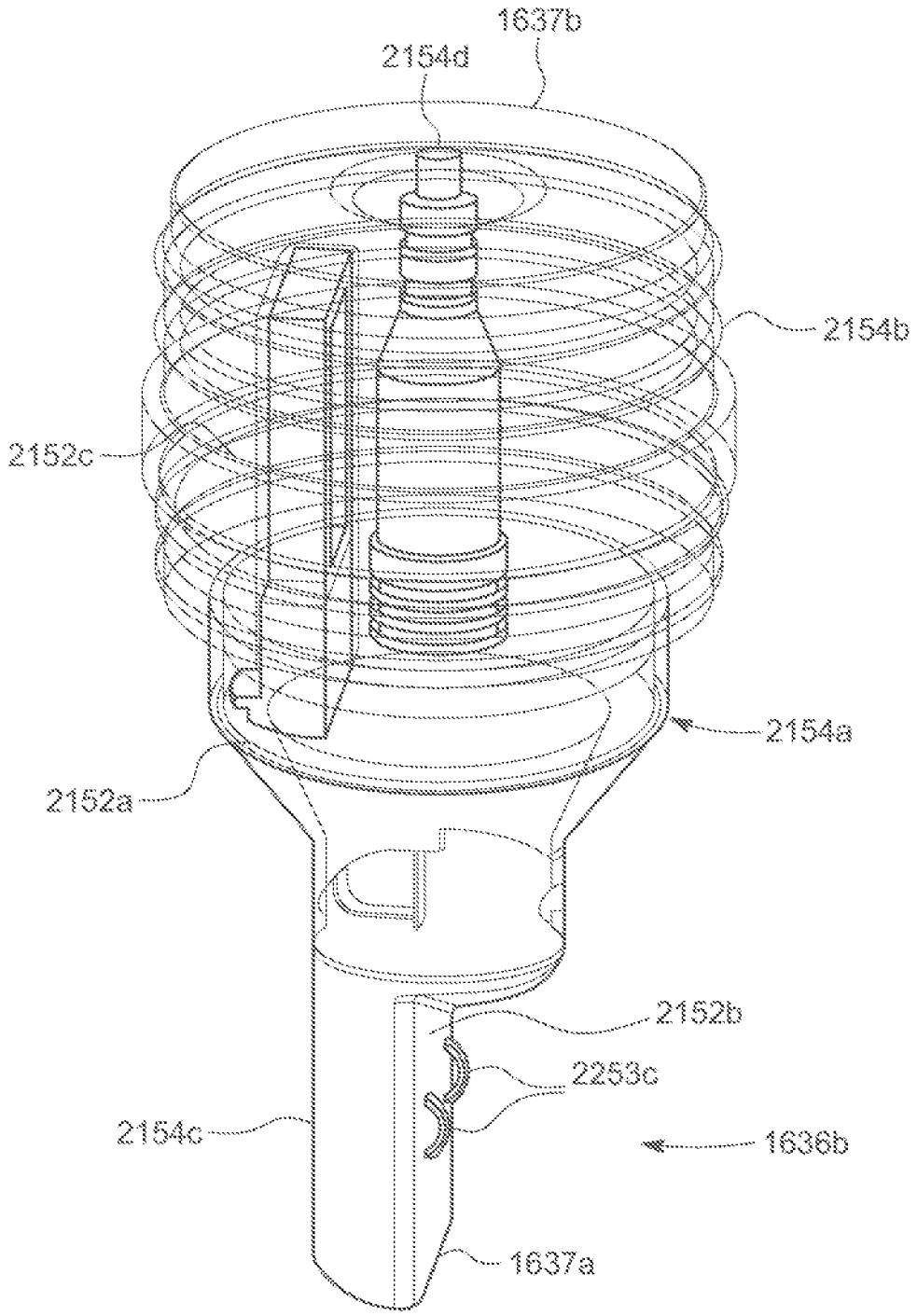
FIGS. 21A-21C are hidden line, perspective view, and end views, respectively, of a detonator assembly of the perforating unit of FIG. 16.
Figure 21B:
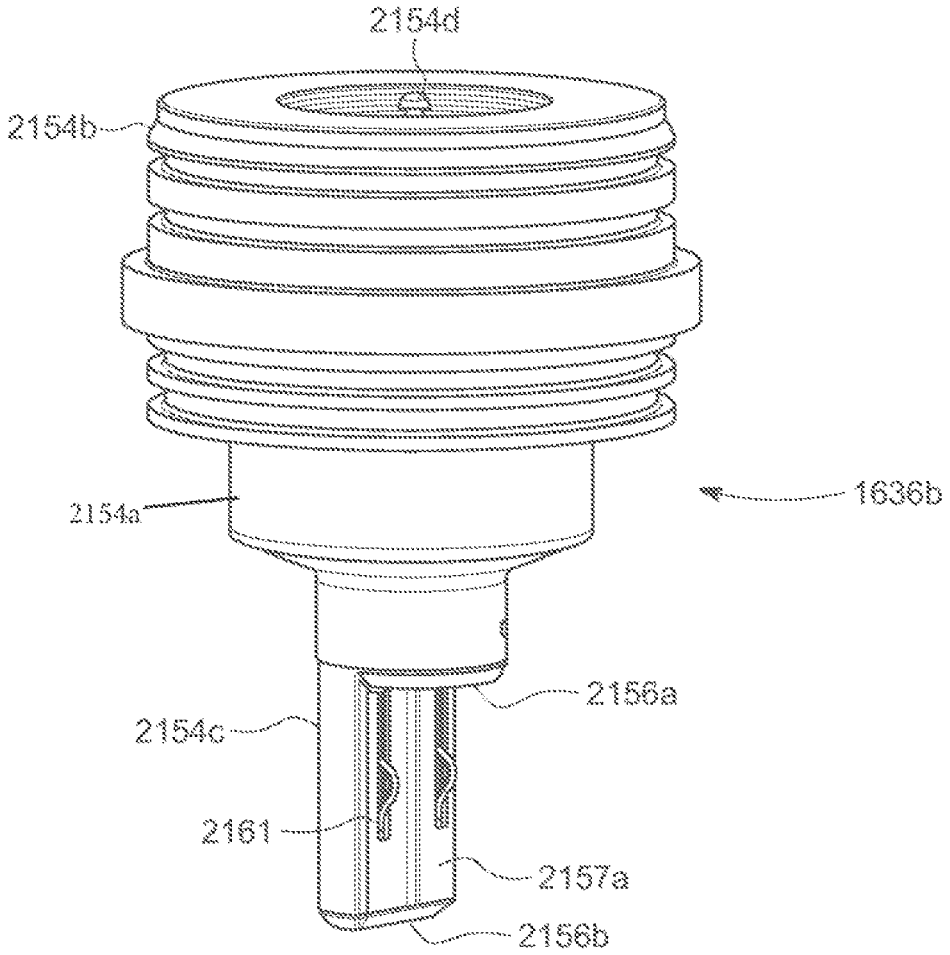
Figure 21C:
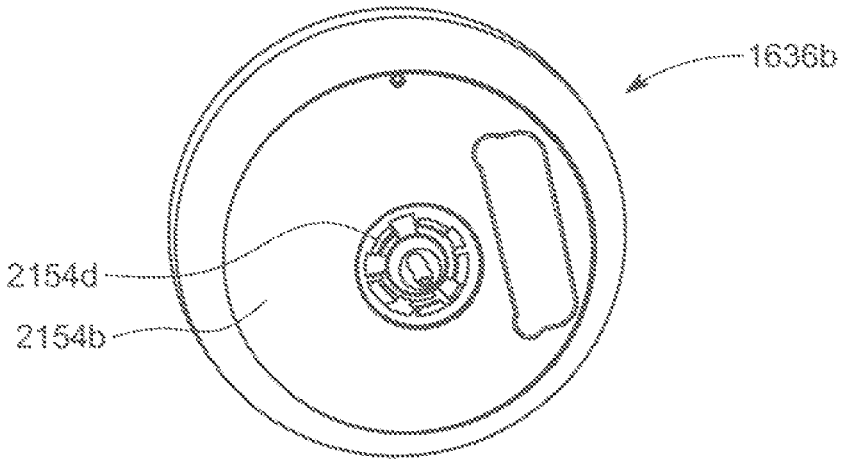
Figure 22:
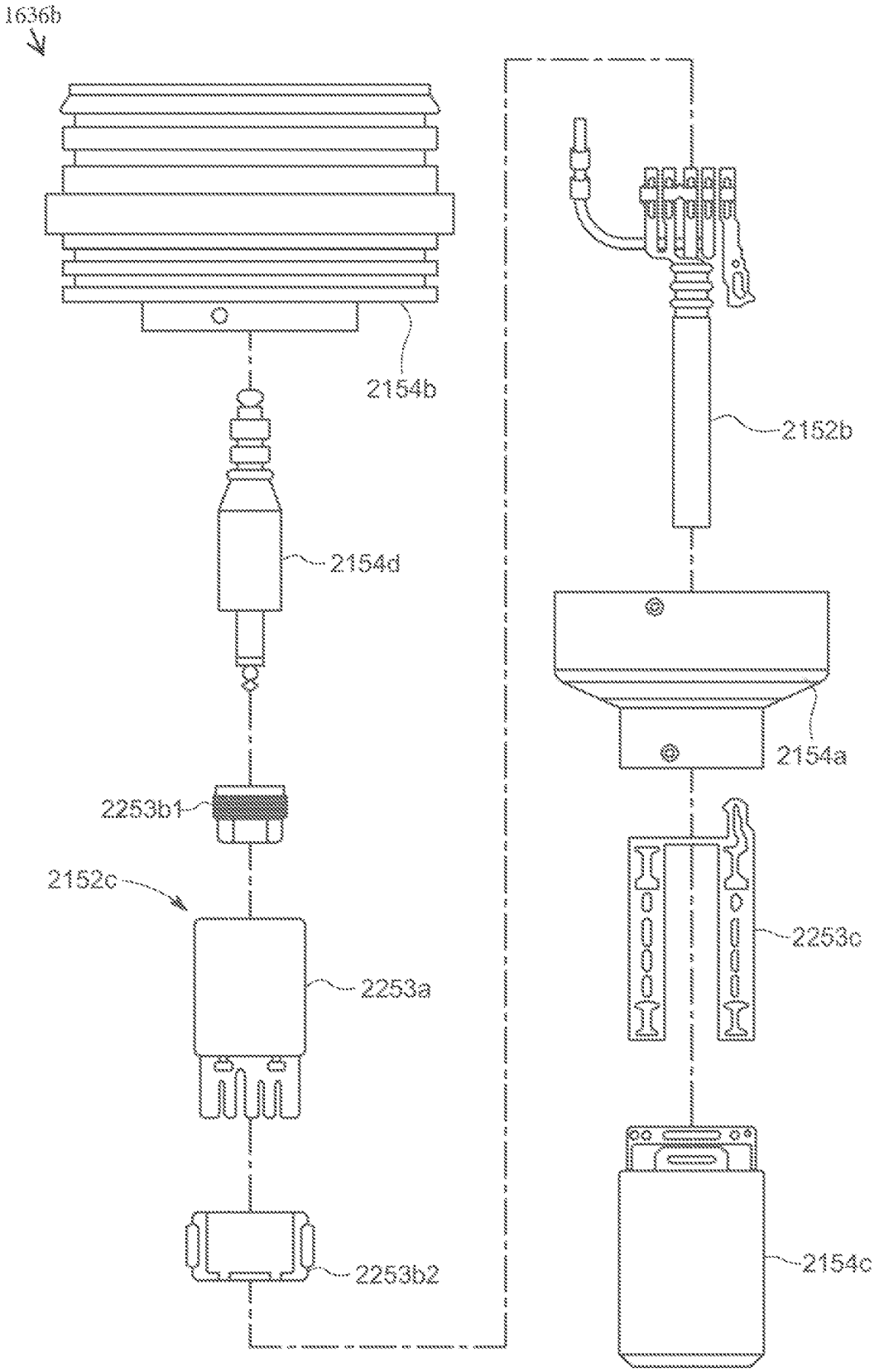
FIG. 22 is an exploded view of the detonator assembly.

Referring collectively to FIGS. 18A-19C and 21B-21C, the detonator assembly 1636*b* is connectable to the outer housing 1633 and shaped for mating and communicative connection to the receiver 1640*b* and the charge feedthru 1640*c*. FIGS. 21A-22 show the detonator assembly 1236*b* in greater detail. FIGS. 21A-21C are hidden line, perspective view, and end views, respectively, of the detonator assembly 1636*b* of the perforating unit 1632. FIG. 22 is an exploded view of the detonator assembly 1636*b*.

As shown in these views, the detonator assembly 1636*b* includes a detonator housing 2154*a*, a bulkhead 2154*b*, a charge (second) connector 2154*c*, a detonator 2152*b*, a switch assembly (or trigger) 2152*c*, and a detonator feedthru 2154*d*. The detonator assembly 1636*b* may be assembled and oriented azimuthally to minimize mechanical shock during the electrical connection therebetween.

The bulkhead 2154*b* is at a charge end 1637*b* of the detonator housing 2152*a* and the charge connector 2154*c* is at the connection end 1637*a* of the detonator housing 2152*a* with the detonator housing 2152*a* therebetween. The detonator feedthru 2154*d* is supported in the bulkhead 2154*b* and the detonator 2152*b* is supported in the charge connector 2154*c* with the switch assembly 2152*c* connected therebetween. The bulkhead 2154*b* acts as a dual contact electrical connector on one side with the centralized detonator feedthru 2154*d* (which acts as an electrical pin) on the other. The bulkhead 2154*b* isolates the gun from pressure created when a shaped charge 136 in a perforating unit 1632 is fired, and maintains contact via the detonator feedthru 2154*d*.

The connection end 1637*a* of the charge connector 2154*c* is insertable into the outer housing 1630 and into the receiver 1640*b* positioned therein (see. e.g., FIG. 18B). The connection end 1637*a* of the charge connector 2154*c* may be shaped for mating insertion into the charge receptacle 1644 of the receiver 1646*b* in a similar manner as the second connector 754*c* of FIG. 12. Upon insertion, the connection end 1637*a* may be threadedly connected to the outer housing 1630. As shown in FIG. 17B, the charge end 1637*b* may be positioned adjacent the charge feedthru 1640*c* and threaded into the outer housing 1630 of an adjacent detonation assembly 1633, thereby connecting two adjacent detonation assemblies 1633. The charge end 1637*b* of the bulkhead 2154*b* is insertable into the outer housing 1630 for engagement with the charge feedthru 1640*c*. As shown in FIG. 21A, the bulkhead 2154*b* supports the detonator feedthru 2154*d* about the charge end 1637*b* of the detonator assembly 1636*b* for communicative connection to the plunger 1647*b* of the charge feedthru 1640*c*.

The detonator feedthru 2154*d* is connected by the switch assembly 2152*c* to the detonator 2152*b*. The switch assembly 2152*c* includes a switch 2253*a*, plugs 2253*b*1, *b*2, and contact 2253*c*. The plugs 2253*b*1, *b*2 are seated in the switch 2253*a*. The detonator 2152*b* is connected to the switch 2253*a* by connectors (not shown) for communication thereby, which may have features similar to those of in FIG. 21. At the connection end 1637*a*, the contacts 2253*c* extend through the charge connector 2154*c* for contact and communication with corresponding connectors (not shown) in the receiver 1646*b*. At the charge end 1637*b*, the detonator feedthru 2154*d* extends from the bulkhead 2154*b* for engagement with the plunger 1647*b* of the charge feedthru 1640*c* (FIG. 20B). The switch assembly 2152*c* connects the contacts 2253*c* and the detonator feedthru 2154*d* for communication therebetween.

In operation, a signal is sent from the surface unit 111 (shown in FIG. 1) via the wireline 116 and to the downhole (perforating) tool 118, 1618 (see, FIGS. 3 and 16, respectively). The signal passes through each of the perforation units 132, 1632 and to the detonator assemblies 436*b*, 1636*b* of FIGS. 2-15 and FIGS. 16-22, respectively. When an electric communication signal from the surface unit 111 is passed through the downhole tool 118, 1618 by communication link 441, the signal is passed to a desired perforating unit 132, 1632. The signal identifies the detonator assembly 436*b*, 1636*b* for a particular perforating unit 132, 1632. Once identified, the switch assembly 752*a*, 2252*a* opens enabling power to pass to the detonator 752*b*, 2252*b* for that perforating unit 132, 1632.

The signal passes through the detonator feedthru 754*d*, 2154*d* and the bulkhead 754*b*, 2154*b*, and to the switch assembly 752*d*, 2152*d* (shown in FIG. 13B). This signal opens the electric switch 753*a*, 2253*a*, allowing electrical communication between a surface power supply and the detonator 752*b*, 2152*b*. When the power at the surface applies voltage to the detonator 752*b*, 2152*b*, the current is drawn and the detonator 752*b*, 2152*b* causes the shaped charge 136 to explode. The increased power supply voltage results in a current down the communication link 441. This current initiates a propellant within the shaped charge 136, which creates an expanding gas inside. This explosion activates the charge cable 442*a*, 1642*a* which causes the shaped charges 136 in the charge tube (shown in FIGS. 4B, 16) to explode and creating the perforations 135 (shown in FIG. 1).

Figure 23:
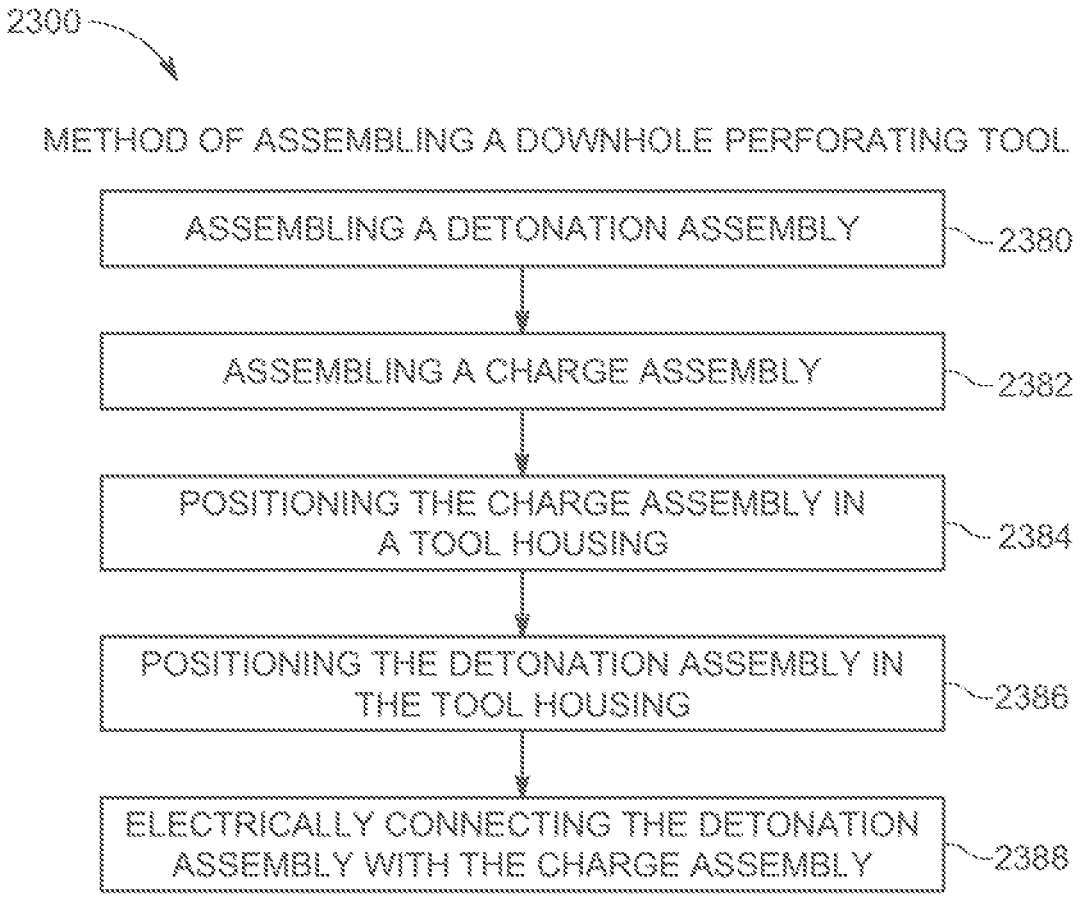
FIG. 23 is a flow chart depicting a method of assembling a downhole perforating tool.

FIG. 23 is a flow chart depicting a method 2300 of assembling a downhole perforating tool, such as those described herein. The method 2300 involves 2380 assembling a detonator assembly; 2382 assembling a charge assembly; 2384 positioning the charge assembly in a tool housing; 2386 positioning the detonator assembly in the tool housing; and 2388 electrically connecting the detonator assembly with the charge assembly.

The method 2300 may involve assembling the detonation assembly by: connecting the bulkhead of the detonator assembly to the outer housing, and connecting the detonator assembly to the charge assembly by inserting the charge assembly in the outer housing while receiving the connection end of the charge connector into the receiver; and then connecting the outer housing to the downhole tool.

Part or all of the assembly may be performed on or offsite from the wellsite. Portions of the method may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain connectors are provided herein, it will be appreciated that various forms of connection may be provided. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A detonator assembly for a downhole tool positionable in a wellbore penetrating a subterranean formation, the downhole tool comprising a charge assembly, the detonator assembly comprising:

a detonator housing positionable in the downhole tool, the detonator housing having a first connector and a second connector therein;

a detonator feedthru supported in the first connector;

a detonator positioned in the detonator housing; and a trigger positioned in the detonator housing, the trigger communicatively coupled, when in use, between a remote actuator and the detonator, the trigger comprising:

a switch electrically connected to the detonator feedthru; and a contact electrically connected to the switch, the contact comprising spring-loaded arms extending from the second connector for electrical contact with the charge assembly.

2. The detonator assembly of claim 1, wherein the second connector is connectable to the charge assembly.

3. The detonator assembly of claim 1, wherein the first connector comprises a bulkhead connectable to an outer housing of the downhole tool.

4. The detonator assembly of claim 3, wherein the charge assembly is positionable in the outer housing of the downhole tool.

5. The detonator assembly of claim 1, wherein the spring-loaded arms extend through openings in the second connector for engagement with the charge assembly.

6. The detonator assembly of claim 1, wherein each of the spring-loaded arms comprise a curved portion and a flat portion, each of the curved portion extendable through an opening in the second connector.

7. The detonator assembly of claim 1, wherein the second connector comprises a charge connector having an end with an offset shape matably connectable to a receiver in the charge assembly.

8. The detonator assembly of claim 1, wherein the switch is connected via cables to the detonator feedthru, the detonator, and the contact.

9. The detonator assembly of claim 8, wherein the trigger further comprises a switch plug operatively connected to the switch and the cables.

10. The detonator assembly of claim 1, wherein the detonator is positioned in the second connector.

11. The detonator assembly of claim 1, further comprising a washer positioned between the second connector and the first connector.

12. A detonation assembly for a downhole tool positionable in a wellbore penetrating a subterranean formation, the detonation assembly comprising:

a charge assembly, comprising:

a charge tube positioned in the downhole tool, the charge tube having a receiver therein; and shaped charges supported in the charge tube, the shaped charges operatively connectable to the receiver; and the detonator assembly positionable in the downhole tool, comprising:

a detonator housing positionable in the downhole tool, the detonator housing having a first connector and a second connector therein;

a detonator feedthru supported in the first connector;

a detonator positioned in the detonator housing; and a trigger positioned in the detonator housing, the trigger communicatively coupled, when in use, between a remote actuator and the detonator, the trigger comprising:

a switch electrically connected to the detonator feedthru; and a contact electrically connected to the switch, the contact comprising spring-loaded arms extending from the second connector for electrical contact with the charge assembly.

13. The detonation assembly of claim 12, further comprising an outer housing, the charge assembly and the detonator assembly positioned in the outer housing.

14. The detonation assembly of claim 12, wherein the trigger is communicatively connected to the remote actuator through at least one of the charge assembly, a perforating tool, and a wireline.

15. The detonation assembly of claim 12, wherein the second connector is insertable into the receiver of the charge assembly.

16. The detonation assembly of claim 12, wherein the detonator is positioned in the second connector.

17. The detonation assembly of claim 12, wherein the second connector comprises a charge connector having an offset shape corresponding matably receivable in the receiver.

18. The detonation assembly of claim 12, wherein the charge assembly further comprises a charge feedthru supported in the charge tube, the charge feedthru operatively connectable to the detonator feedthru.

19. A detonation assembly for a downhole tool positionable in a wellbore penetrating a subterranean formation, the detonation assembly comprising:

a charge assembly, comprising:

a charge tube positioned in the downhole tool, the charge tube having a receiver therein; and shaped charges supported in the charge tube, the shaped charges operatively connectable to the receiver; and the detonator assembly positionable in the downhole tool, comprising:

a detonator housing positionable in the downhole tool, the detonator housing having a second connector in the detonator housing, the second connector having an offset shape matably receivable into the receiver of the charge tube;

a detonator positioned about the detonator housing; and a trigger positioned in the detonator housing, the trigger comprising:

a switch communicatively coupled, when in use, between a remote actuator and the detonator; and a contact positioned in the second connector, the contact electrically connected with the receiver of the charge assembly when the second connector is matably connected with the receiver.

20. The detonation assembly of claim 19, wherein the receiver has a receptacle with a receptacle shape, the receptacle shape corresponding to the offset shape of the second connector.

21. The detonation assembly of claim 19, wherein the receptacle shape defines an opening for one-way insertion of the second connector into the receiver.

22. The detonation assembly of claim 19, wherein the detonator housing also has a first connector.

23. The detonation assembly of claim 22, further comprising a detonator feedthru supported in the first connector, the detonator feedthru electrically connected to the switch.

24. The detonation assembly of claim 22, wherein the first connector comprising a bulkhead operatively connected to an outer housing, the detonation assembly and the charge assembly positioned in the outer housing.

25. The detonation assembly of claim 24, wherein the bulkhead isolates pressure in the charge tube from pressure in the detonator housing.

26. A method of assembling a downhole tool, the method comprising:

assembling a detonator assembly by:

communicatively connecting a trigger to a detonator;

positioning the detonator and the trigger in a second connector of a detonator housing;

positioning the detonator housing in the downhole tool; and connecting the detonator housing to a charge assembly in the downhole tool by inserting the second connector of the detonator housing into the charge assembly such that a contact of the trigger is urged into electrical contact with the charge assembly.

27. The method of claim 26, further comprising assembling the charge assembly by positioning a shaped charge into a charge tube.

28. The method of claim 26, further comprising inserting the charge assembly into the downhole tool.

29. The method of claim 26, further comprising communicatively connecting the trigger to a remote actuator.

30. The method of claim 26, further comprising, during connecting the detonator housing to the charge assembly, allowing a shape of the second connector to orient about a corresponding shape of an opening in the charge assembly.

31. The method of claim 26, further comprising, during connecting the detonator housing to the charge assembly, allowing a connector surface of the second connector to align with a receiver surface of the charge assembly.

32. The method of claim 26, further comprising isolating pressure in the charge assembly from pressure in the detonator assembly by connecting the detonator housing to an outer housing.

* * * * *